US010518941B2

(12) United States Patent
Jelich

(10) Patent No.: US 10,518,941 B2
(45) **Date of Patent: *Dec. 31, 2019**

(54) DISPENSING CLOSURE

(71) Applicant: AptarGroup, Inc., Crystal Lake, IL (US)

(72) Inventor: Nicholas J. Jelich, Oconomowoc, WI (US)

(73) Assignee: APTARGROUP, INC., Crystal Lake, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/295,552

(22) Filed: Mar. 7, 2019

(65) Prior Publication Data

US 2019/0202609 A1 Jul. 4, 2019

Related U.S. Application Data

(63) Continuation of application No. 15/539,187, filed as application No. PCT/US2017/012682 on Jan. 9, 2017, now Pat. No. 10,266,313.

(51) Int. Cl.

| | |
|---|---|
| ***B65D 47/08*** | (2006.01) |
| ***B65D 47/20*** | (2006.01) |
| ***B65D 50/06*** | (2006.01) |

(52) U.S. Cl.

CPC ..... *B65D 47/08* (2013.01); *B65D 47/2006* (2013.01); *B65D 50/06* (2013.01)

(58) Field of Classification Search

CPC .... B65D 47/08; B65D 47/2006; B65D 50/06; B65D 50/061; B65D 50/02

(Continued)

(56) References Cited

U.S. PATENT DOCUMENTS 4,838,460 A 6/1989 Moore et al.
5,279,451 A * 1/1994 Mueller ..... B65D 47/242 222/507

(Continued)

OTHER PUBLICATIONS

International Search Report and Written Opinion from the U.S. acting as International Searching Authority for PCT/US17/12682 of which this subject application is a U.S. National Stage. p. 10 of which indicates that PCT claims 10 and 16 possess novelty, inventive step, and industrial applicability.

*Primary Examiner* — Benjamin R Shaw

(74) *Attorney, Agent, or Firm* — Wood, Phillips, Katz, Clark & Mortimer

(57) ABSTRACT

A dispensing closure (40) for a fluent substance-containing system, such as a container, includes a body (54) for receiving the fluent substance from the system, a locking member (56) assembled with the body (54), and a pivotable actuator (60) assembled with the locking member (56) and defining a dispensing flow passage (190) for discharging the fluent substance. The locking member (56) is rotatable relative to the body (54) from a locking position to an unlocking position to permit a user to pivot the actuator (60) from a closed position to a dispensing, open position. The body (54) has an abutment (110) that extends through the locking member (56) in the locking position to prevent the actuator (60) from moving into the open position. In the unlocking position of the locking member (56), the actuator (60) is not prevented by the abutment (110) from being moved into the open position.

19 Claims, 22 Drawing Sheets

(58) Field of Classification Search
USPC ..... 222/153.14
See application file for complete search history.

(56) References Cited

U.S. PATENT DOCUMENTS

| | | | | |
|---|---|---|---|---|
| 5,284,264 | A | 2/1994 | Gross | |
| 5,314,093 | A * | 5/1994 | Gross | B65D 50/067 215/235 |
| 5,379,926 | A * | 1/1995 | Mueller | B65D 47/2006 222/507 |
| 6,029,866 | A * | 2/2000 | Wood | B29C 45/1676 215/235 |
| 6,065,648 | A | 5/2000 | Tauber | |
| 6,102,225 | A | 8/2000 | Lynn | |
| 6,283,333 | B1 * | 9/2001 | Knickerbocker | B65D 47/2006 222/153.14 |
| 10,167,120 | B1 * | 1/2019 | Levy | B65D 50/06 |
| 2002/0179644 | A1 | 12/2002 | Evans et al. | |
| 2004/0112927 | A1 | 6/2004 | Kaufman et al. | |
| 2004/0149787 | A1 | 8/2004 | Englert et al. | |
| 2004/0159684 | A1 * | 8/2004 | Roberts | B65D 47/2006 222/556 |
| 2009/0272742 | A1 | 11/2009 | Dybala | |
| 2016/0257461 | A1 | 9/2016 | Chehadeh | |

* cited by examiner

DISPENSING CLOSURE

CROSS-REFERENCE TO RELATED APPLICATION(S)

This application is a continuation of U.S. patent application Ser. No. 15/539,187, filed Jun. 23, 2017, which is a National Phase Application under 35 U.S.C. § 371 of International Patent Application Serial No. PCT/US2017/012682, filed Jan. 9, 2017, and those prior patent applications are incorporated here by reference in their entirety to provide continuity of disclosure, and applicant claims the benefit of those prior applications.

TECHNICAL FIELD

The present invention relates generally to a dispensing closure for a container or other system that contains a fluent substance.

BACKGROUND OF THE INVENTION AND TECHNICAL PROBLEMS POSED BY THE PRIOR ART

Closures are employed to selectively prevent or permit communication between the exterior and interior of a system (e.g., machine, equipment, containment system (including containers such as bottles and pouches), etc.) through an opening in the system. A typical closure includes at least (1) a receiving structure (e.g., a body, base, fitment, etc.) at an opening to the system interior, and (2) a closing element (e.g., a lid, cover, overcap, pivotable disc top type actuator, etc.) that is cooperatively received by the receiving structure.

The receiving structure of the closure can typically be either (1) a separate structure that (a) can be attached at such a system opening, and (b) defines at least one passage through the receiving structure for communicating through such a system opening with the interior of such a system, or (2) an integral structure that is a unitary portion of such a system and that defines at least one passage through the integral structure such that the passage functions as the opening, per se, to the system.

The closing element typically is movable relative to the receiving structure passage between (1) a fully closed position occluding the passage, and (2) an open position at least partially exposing the passage. Some closures may include additional elements (e.g., tamper-evident features, locking elements, etc.).

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. If the container is a bottle, pouch, or other such container, then such a container with the closure mounted thereon and the contents stored therein may be characterized as a "package."

One type of dispensing closure is a toggle action type, which typically is provided with a closing element in the form of a generally flat, disc top type actuator or a domed type actuator for dispensing a fluent substance. A user of such a closure will typically encounter the actuator in a closed, non-dispensing position. The actuator may be provided with a region for being pressed upon by a user of the closure to toggle, tilt, pivot, or otherwise rotate the actuator with respect to a stationary portion of the closure (e.g., closure body), moving the actuator from the closed position into an open position such that a fluent substance may be dispensed through the closure. Such an actuator may subsequently be pressed upon by a user, at a different region of the actuator, to toggle, pivot, or otherwise rotate the actuator back into the closed, non-dispensing position.

The inventor of the present invention has noted that, in some applications, such toggle action type closures, when installed in or on a system (e.g., a container of a fluent substance), may be susceptible to inadvertent opening during manufacturing, shipping, or handling, which can result in premature or messy leaking of the fluent substance from the closure. Inadvertent opening of such a closure may be prevented, or at least minimized, by applying an adhesive seal or a film wrap around at least a portion of the closure to mechanically prevent movement of the actuator until the seal or wrap has been removed by a user of the closure. Such additional seals or wraps may increase the cost of the closure, require additional manufacturing steps, or present a nuisance to the user who must remove such a seal or wrap.

The inventor of the present invention has determined that it would be desirable to provide an improved toggle action dispensing closure for preventing inadvertent opening of the closure.

The inventor of the present invention has further determined that it would be beneficial to provide an improved toggle action dispensing closure that would facilitate repeatable and easy locking and unlocking of the closure by a user.

The inventor of the present invention has also determined that, in many applications, it may be desirable to provide an improved toggle action dispensing closure as part of a package wherein the closure structure facilitates or accommodates the cleaning of the closure and/or minimizes the potential for accumulation of residue, dirt, grime, etc. during the useful life of the package.

The inventor of the present invention has also determined that it would be desirable to provide an improved toggle action dispensing closure that can be configured for use with a container of a fluent substance so as to have one or more of the following advantages: (1) an improved ease of manufacture and/or assembly, and (ii) a reduced cost of manufacture and/or assembly.

The inventor of the present invention has invented a novel structure for a toggle action dispensing closure for use with a system, which could be a container or other type of system, wherein the closure includes various advantageous features not heretofore taught or contemplated by the prior art.

BRIEF SUMMARY OF THE INVENTION

According to broad aspects of one form of the present invention, a dispensing closure is provided for a system having an opening between an exterior of the system and an interior of the system where a fluent substance may be stored. The dispensing closure has a closure body that can be located at the system opening and that defines an inlet for communicating with the system. The closure body further has an end defining an aperture to accommodate the flow of a fluent substance through the closure body.

The dispensing closure has a locking member mounted on the closure body for rotation about a central rotational axis. The locking member has an intermediate flow passage for accommodating the flow of a substance through the closure body aperture. The locking member has a locking position, and an unlocking position rotated about the central rotational axis away from the locking position.

The dispensing closure has an actuator that is rotatably mounted to the locking member for occluding the locking member intermediate flow passage to prevent flow of a fluent substance through the closure when the actuator is in a closed, non-dispensing position and for permitting flow of a fluent substance through the closure when the actuator is rotated to an open, dispensing position. The actuator includes a dispensing flow passage that is in communication with the intermediate flow passage of the locking member when the actuator is in the open, dispensing position. The actuator is in engagement with a portion of the closure body when the locking member is in the locking position to prevent the actuator from moving into the open, dispensing position.

In one aspect of the present invention, the closure body is adapted for use with a system that is a container defining the opening and the closure body is one of: a separate structure for being attached to the container at the container opening; and an integral structure that is a unitary part of a container formed at the container opening.

In another form of the present invention, the end of the closure body includes a top deck defining an upper surface, and the locking member includes a bottom deck defining a bottom surface confronting the closure body upper surface.

In yet another form of the present invention, the dispensing closure aperture of has a configuration centered on the central rotational axis and at least a portion of the intermediate flow passage of the locking member is offset from the central rotational axis.

In one aspect of the present invention, the actuator includes at least one downwardly extending abutment and the closure body includes an upwardly extending abutment whereby the downwardly-extending abutment and the upwardly extending abutment are oriented to engage to prevent the actuator from moving into the open, dispensing position when the locking member is in the locking position.

According to another form of the present invention, the locking member includes a bottom deck defining an aperture and the upwardly extending abutment of the closure body extends through the aperture.

According to another aspect of the present invention, the upwardly extending abutment of the closure body has a radius of curvature centered on the central rotational axis, and the downwardly extending abutment of the actuator has a length extending an oblique angle relative to the radius of curvature.

In one form of the invention, the closure body has at least one retaining projection extending upwardly from the closure body end, and the locking member has at least one arcuate slot therein for receiving the retaining projection.

In still yet another form of the invention, the closure body has a plurality of circumferentially-spaced retaining projections, and the locking member has a plurality of circumferentially-spaced arcuate slots therein, each one of the arcuate slots receiving a different one of the retaining projections.

In still another aspect of the present invention, the end of said closure body has an upper surface with at least one recess therein. The locking member has at least one resilient projection having a bead. Rotation of the locking member relative to the closure body carries the projection in an arc with the bead engaging the surface so that the projection is deflected by the surface. Continued rotation of the locking member relative to the closure body carries the projection to a location in which the at least one recess receives the bead, whereupon the projection returns to its undeflected condition as the bead snaps into the at least one recess to generate at least one of an audible signal and a tactile signal.

In still another aspect of the present invention, the closure body has at least one projection extending therefrom. The locking member has at least one resilient, deflectable tab extending therefrom, whereby rotation of the locking member relative to the closure body moves the projection against and past the tab which deflects and returns to its undeflected condition to generate at least one of an audible signal and a tactile signal.

In another aspect of the present invention, the closure body has at least one indicium, and the locking member has at least one indicium that cooperate to indicate whether the locking member is in one of the locking position and the unlocking position.

In still another form of the present invention, the locking member is rotatable less than 45 degrees about the central rotational axis between the locking position and the unlocking position.

According to another form of the present invention, the closure body further includes an upwardly extending wall surrounding and defining at least a portion of the aperture, and the locking member includes a downwardly extending wall sealingly engaged with the closure body upwardly extending wall.

According to another form of the present invention, the actuator includes a pair of oppositely extending protrusions, and the locking member includes an outer wall having a pair of facing recesses therein to each receive a different one of the protrusions.

According to another form of the present invention, the locking member includes a bottom deck having a plurality of circumferentially-spaced arcuate slots therein, each of the slots having the same radius of curvature. The bottom deck includes an arcuate aperture having a radius of curvature less than the radius of curvature of the slots.

In another aspect of the present invention, the locking member includes a raised central deck and a spout extending upwardly from the raised central deck. The intermediate flow passage extends through the raised central deck and the spout.

According to another form of the present invention, the closure body end includes an upwardly extending wall and the locking member defines an annular channel for receiving the wall.

According to another form of the present invention, the dispensing closure is in combination with a system that is a container of a fluent substance. The closure and container together defining a package.

It should be appreciated that the invention may include any or all of the above-described features, include only one of the above features, more than one of the above features, and any combination of the above features. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 3 shows the closure oriented about 100 degrees from the orientation in FIG. 1 so as to show a "rear" region of the closure which is only partially visible in FIG. 1, and FIG. 3 further shows the locking member of the closure oriented in a locked position;

FIG. 29 shows the locking member rotated relative to the closure body to a location between a locking position and the unlocking position;

DESCRIPTION OF THE PREFERRED EMBODIMENT

Figure 1:
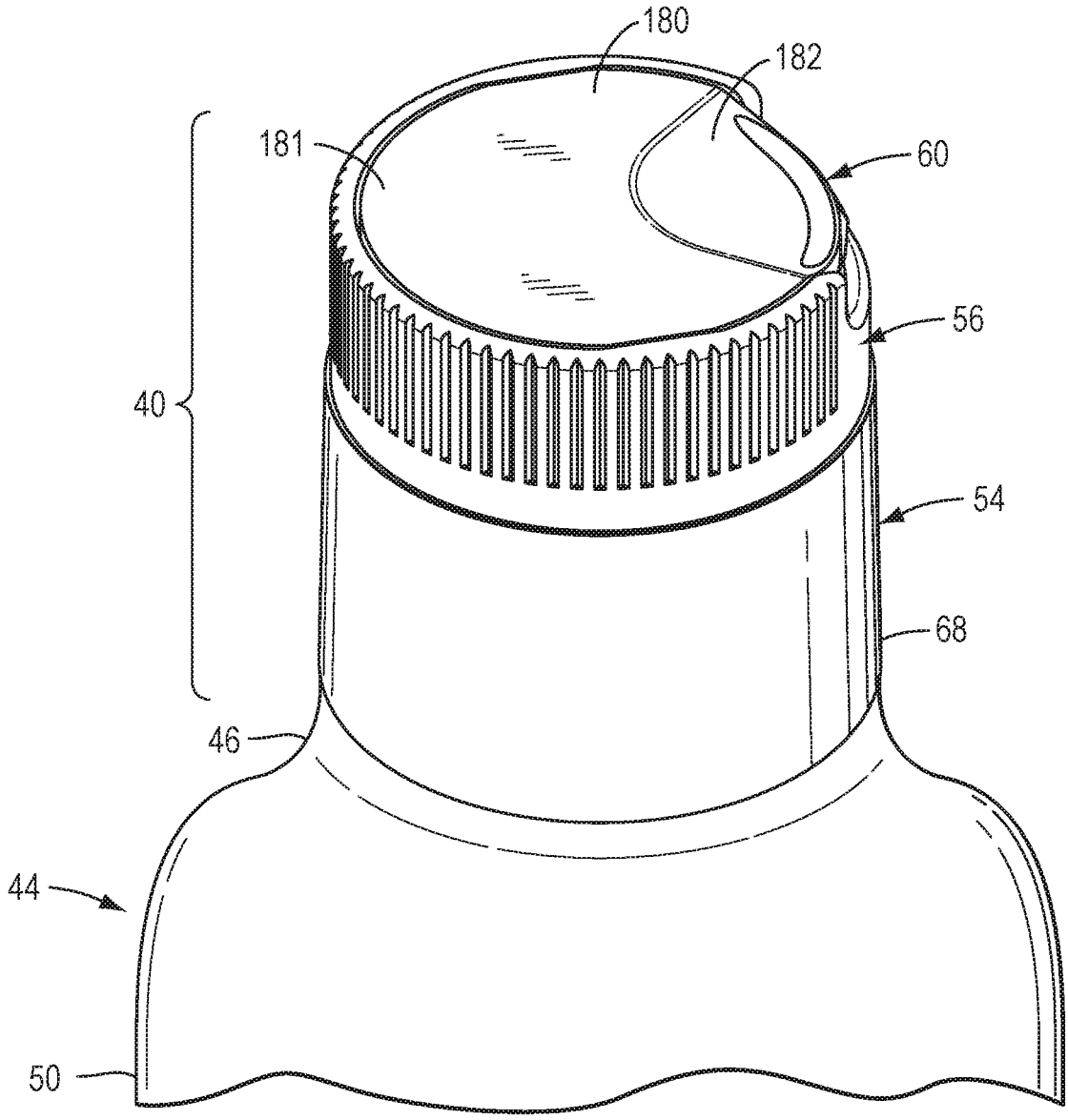
FIG. 1 is a perspective view, taken from above, of a first embodiment of a dispensing closure of the present invention shown installed at the opening of a container wherein only a fragmentary, upper portion of the container is illustrated in FIG. 1.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show an embodiment in the typical orientation that the closure would have at the opening of a system that is a container in the form of an upright bottle, and terms such as "inward", "outward", "upper", "lower", "axial", "radial", "lateral", etc., are used with reference to this orientation. The terms "axial" and "radial" are used with respect to a central rotational axis or axis "A" (FIG. 2), generally defined as the axis of rotation about which a locking component of closure rotates as discussed in greater detail hereinafter. The phrase "axially inwardly" refers to the direction along the central rotational axis "A" toward the bottom of the closure and toward the container interior. The phrase "axially outwardly" refers to the opposite direction along the central rotational axis "A" toward the top of the closure and away from the container interior. It will be understood, however, that the closure of this invention may be manufactured, stored, transported, used, and sold in an orientation other than the orientation described.

The dispensing closure, or simply closure, of this invention is especially suitable for use with, among other things, a variety of conventional or special systems, including containers, the details of which, although not fully illustrated or described, would be apparent to those having skill in the art and an understanding of such containers. The particular container, per se, that is illustrated and described herein forms no part of, and therefore is not intended to limit, the present invention. It will also be understood by those of ordinary skill that novel and non-obvious inventive aspects are embodied in the described exemplary closures alone.

The closures described herein are especially suitable for use on a container that contains a fluent material or substance in the form of a lotion or cream that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, manufacturing, commercial or household maintenance, construction, agriculture, etc.).

A first embodiment of a closure of the present invention, and the components thereof, are illustrated in FIGS. 1-30, wherein the closure is designated generally by the reference number 40. In the first illustrated embodiment, the closure 40 is provided in the form of a separate article which is configured to be attached or assembled to a system such as a container 44 that would typically contain a fluent substance.

The container 44 may be any conventional type, such as a collapsible, flexible pouch, or may be a generally rigid container that has somewhat flexible, resilient walls, such as a bottle or tank. FIG. 1 shows an embodiment of the closure 40 attached to a container 44 that is a generally rigid bottle having a wall that is somewhat flexible and that can be squeezed by the user to dispense a product when the closure 40 is opened. The closure 40 may instead be used on a larger dispensing system (not illustrated) which may include, or be part of, for example, a medical device, processing machine, dispenser, reservoir on a machine, etc., wherein the system has an opening to the system interior.

The container 44, or a portion thereof, may be made from a material suitable for the intended application (e.g., a thin, flexible material for a pouch (wherein such a material could be a polyethylene terephthalate (PET) film or a polyethylene film and/or an aluminum foil), or a thicker, less flexible material such as molded polyethylene or polypropylene for a more rigid container 44 such as a bottle).

In applications wherein the closure 40 is mounted to a container 44 such as a bottle or pouch (not illustrated), it is contemplated that typically, after the closure manufacturer would make the closure (e.g., by molding parts of the closure 40 from a thermoplastic polymer and assembling them), the closure manufacturer will then ship the closure 40 to a container filler facility at another location where the container 44 is either manufactured or otherwise provided, and where the container 44 is filled with a product prior to installation of the closure. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the first illustrated embodiment of the closure 40, the closure 40 is provided as a separately manufactured article, component, or unit for being screwed onto the container 44. It will be appreciated, however, that in some applications, it may be desirable for the closure 40 to be attached to a container in a manner that would not allow a user to easily remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

The first illustrated embodiment of the closure 40, if initially formed separately from the container 44, is adapted to be attached to the container 44 at an opening in the container which provides access to the container interior and to the fluent contents contained therein after a portion of the closure 40 is opened as described hereinafter.

The container 44, per se, such as a bottle, pouch, or other container, per se, does not form a part of the broadest aspects of the present invention. The container, or other system, may have any suitable configuration.

With reference to FIG. 1, where the illustrated container 44 is a bottle, the bottle typically includes an upper end portion 46 (or other suitable structure on some part of the bottle) that defines the bottle mouth or opening and a threaded portion (or snap-fit bead, not illustrated) for mating with a cooperating threaded portion (or snap-fit bead, not illustrated) of the closure 40, which is discussed in detail hereinafter. The bottle upper end portion 46 typically has a cross-sectional configuration with which the closure 40 is adapted to engage. Extending from the upper end portion 46 is a main body portion 50 of the bottle. The main body portion 50 has a cross-sectional configuration that differs from the cross-sectional configuration of the bottle upper end portion 46 at the bottle opening. In other types of bottles, the bottle may instead have a substantially uniform shape along its entire length or height without any portion of reduced size or different cross-section.

The first embodiment of the closure 40 illustrated in the FIGS. 1-30 is especially suitable for use with a container 44 that is a bottle having a substantially flexible wall or walls that can be squeezed or deflected laterally inwardly by the user to increase the internal pressure within the bottle so as to force the fluent substance out of the bottle and through the opened closure 40. The walls have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system (not illustrated), or to reduce the exterior ambient pressure so as to suck the material out through the open closure.

In some other applications, the closure 40 may be used with a product containment system or other type of system (not illustrated), where the closure 40 can function to permit or prevent the egress or ingress of substances relative to the system in which the closure 40 is installed.

For example, in some applications it may be desirable to also accommodate filling or refilling of the container 44 (or other system) with the fluent contents through the opened closure 40 into the container 44.

Figure 2:
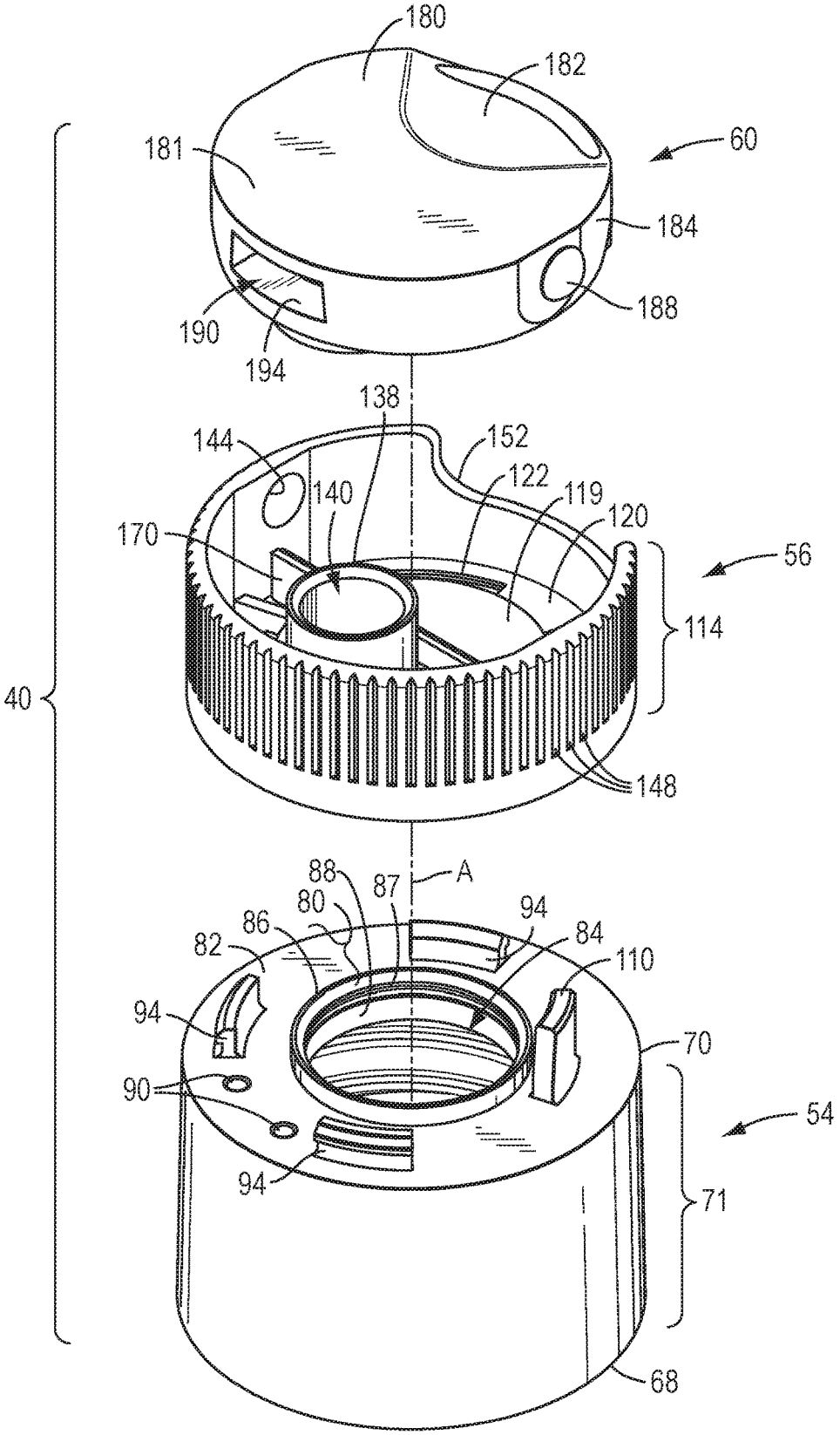
FIG. 2 is an exploded, perspective view of the closure illustrated in FIG. 1.

With reference to FIG. 2, the closure 40 includes the following basic components: a base or closure body 54, a twist collar or locking member 56, and an actuator 60. An optional cap or lid (not illustrated) could be provided for being removably mounted atop of the closure 40. The closure body 54, the locking member 56, and the actuator 60 are preferably formed or molded as separate structures and subsequently assembled together. The closure body 54, the locking member 56, and the actuator 60 are each preferably molded from a suitable thermoplastic material such as polyethylene or polypropylene. Other materials may be employed instead. It will be understood that in alternative designs (not illustrated), two or more of the three basic components may be unitarily formed or molded together initially as one connected structure, and then substantially broken apart, and then assembled in an operative combination. Further, it will be understood that the closure body 54 may be unitarily formed or molded as an extension of the upper end of the container 44.

Figure 3:
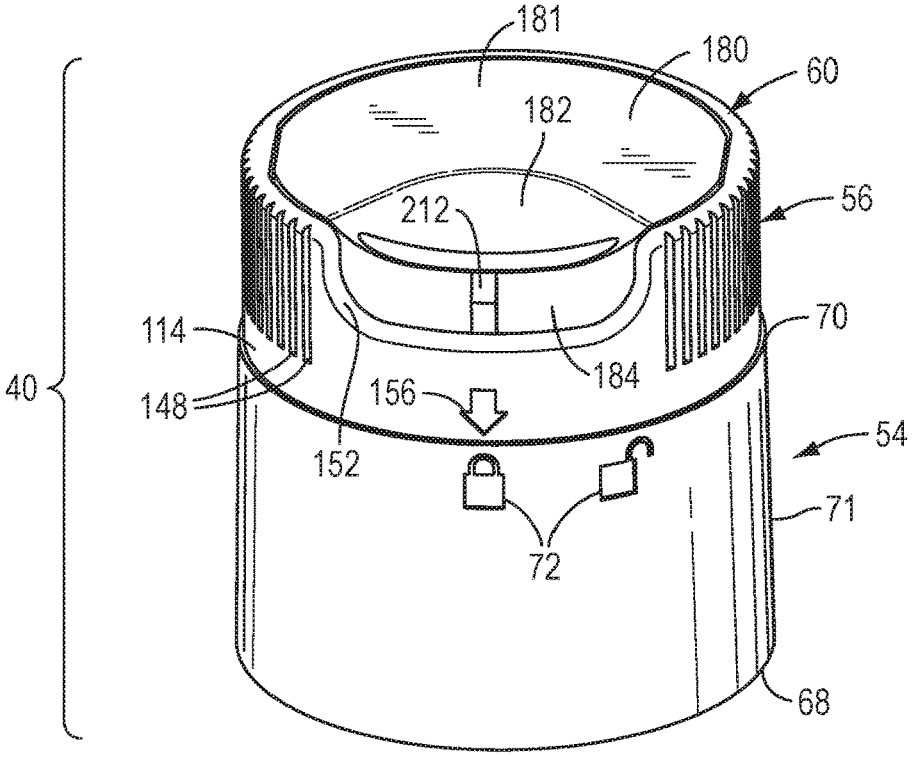
FIG. 3 is a perspective view, taken from above, of the closure illustrated in FIG. 1.
Figure 4:
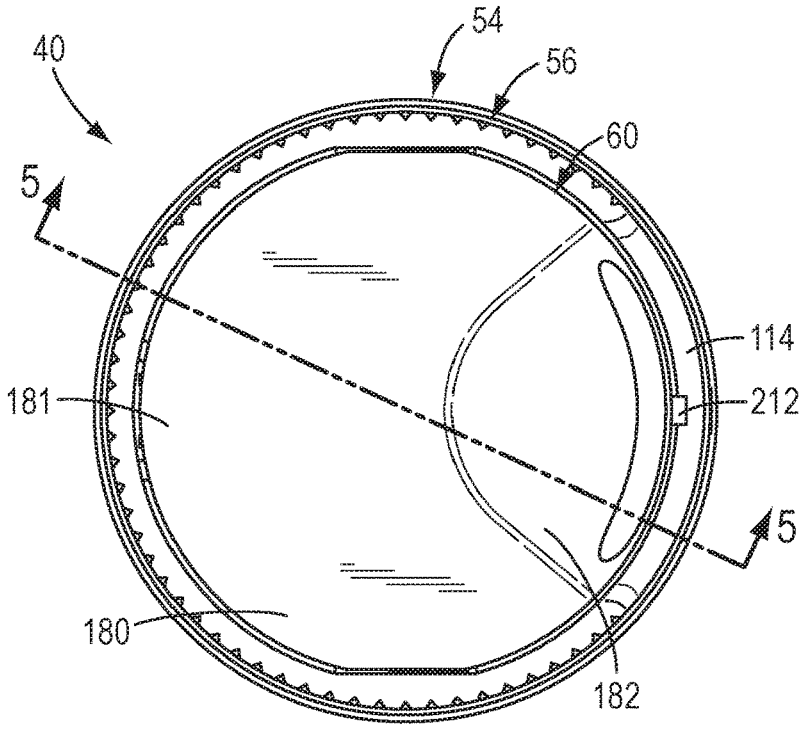
FIG. 4 is a top plan view of the closure illustrated in FIG. 1.

The actuator 60 is movable between an open position (FIG. 10) and a closed position (FIG. 1), and the actuator 60 can be "locked" in the closed position when the locking member 56 is rotated to a locking position from an unlocking position (FIG. 3).

Figure 5:
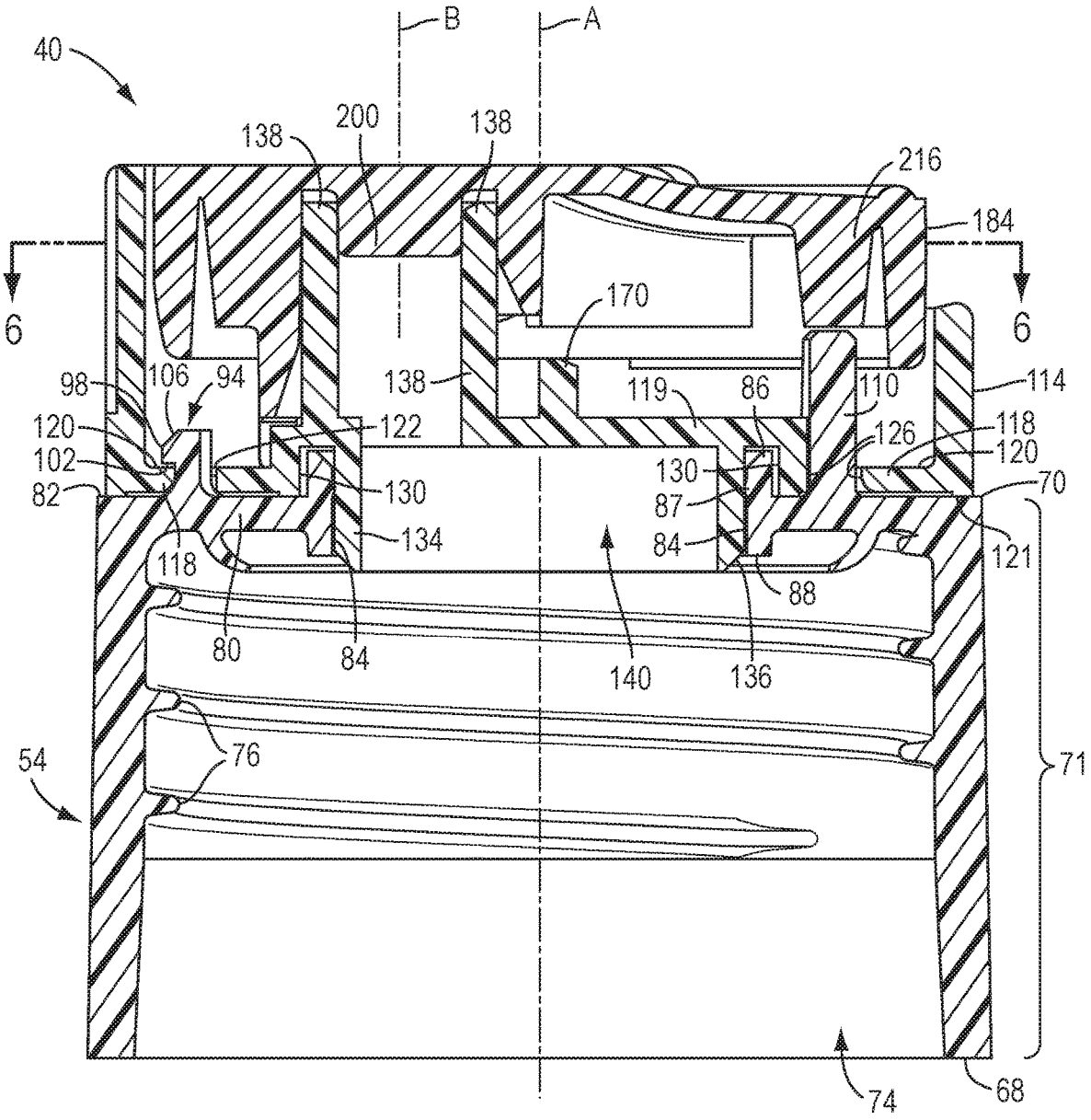
FIG. 5 is a cross-sectional view of the closure illustrated in FIG. 1, taken generally along the plane 5-5 in FIG. 4.
Figure 26:
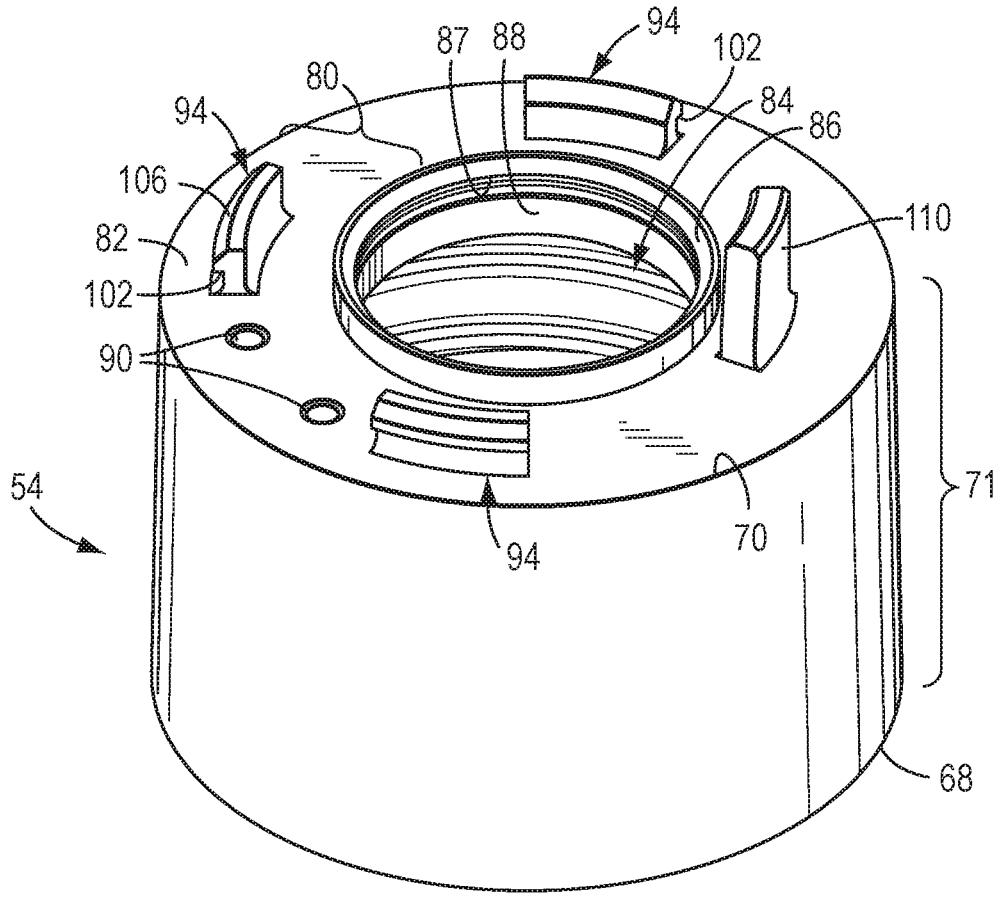
FIG. 26 is a perspective view, taken from above, of the closure body of the dispensing closure illustrated in FIG. 2.
Figure 28:
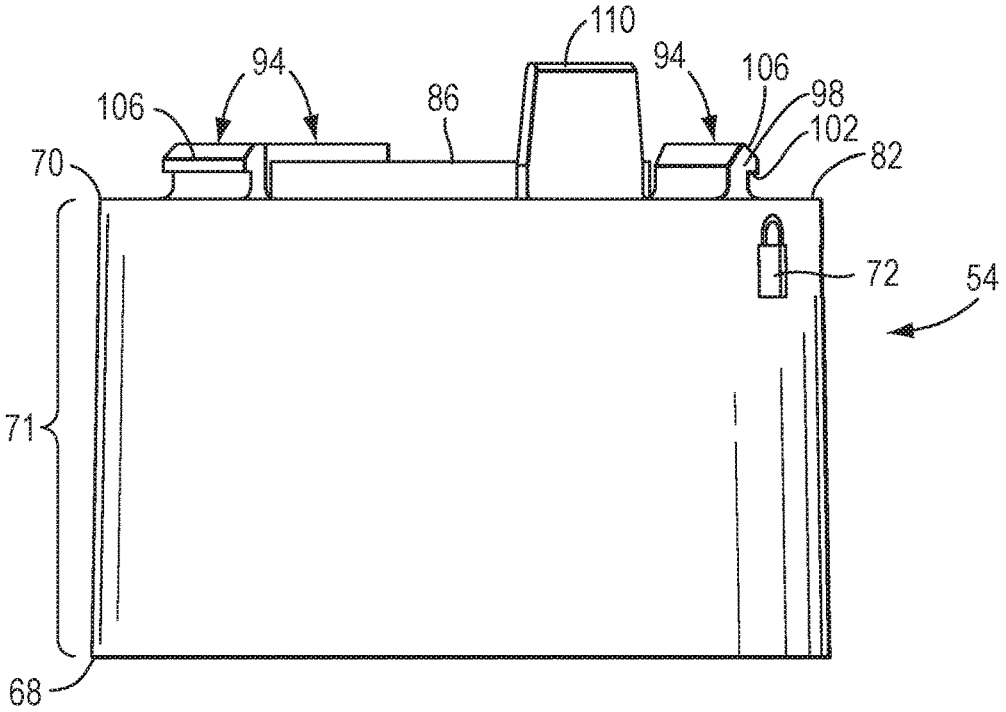
FIG. 28 is a right side elevation view of the closure body shown in FIG. 2.

Referring now to FIGS. 5, 26, and 28, the closure body 54 includes an inlet portion or lower end 68 and an upper end 70. A cylindrical skirt or outer wall 71 extends between the lower end 68 and the upper end 70. The lower end 68 defines an inlet (e.g., passage) 74 (FIG. 5) for being located at the opening of the bottle 44 (FIG. 1) to communicate with an interior of the bottle 44 containing a fluent substance. As shown in FIG. 3, a pair of indicia 72 are located on the outer wall 71, proximal the upper end 70. The indicia 72 function together with an indicium located on the locking member 56 to indicate relative rotation between the closure body 54 and the locking member 56 about the central rotation axis "A" (FIG. 5), as discussed in detail below.

Still referring to FIG. 5, the interior of the closure body 54 is provided with a plurality of internal threads 76 extending radially inwardly therefrom. The internal threads 76 cooperate with, and threadingly engage, mating external threads on the container (not visible in FIG. 1) to securely attach the closure body 54 together with the container 44 (FIG. 1) at the opening of the container 44. It will be appreciated that other conventional or special means of connecting the closure body 54 to the container 44 could be employed, such as mating snap-fit beads, bi-injection molding, adhesives, mechanical locks, spin welding of the closure to the container, etc.

If the closure body 54 is to be used on a flexible pouch (not illustrated), then it is presently contemplated that the closure body lower end 68 would have a suitable boat-shaped fitment configuration (e.g., such as that shown in PCT/US2013/043065, which is incorporated by reference herein in its entirety) for being sealed with the pouch, and most pouch manufacturers will prefer to install the closure body lower end at an opening formed in the pouch with heat sealing techniques or ultrasonic sealing techniques.

Figure 8:
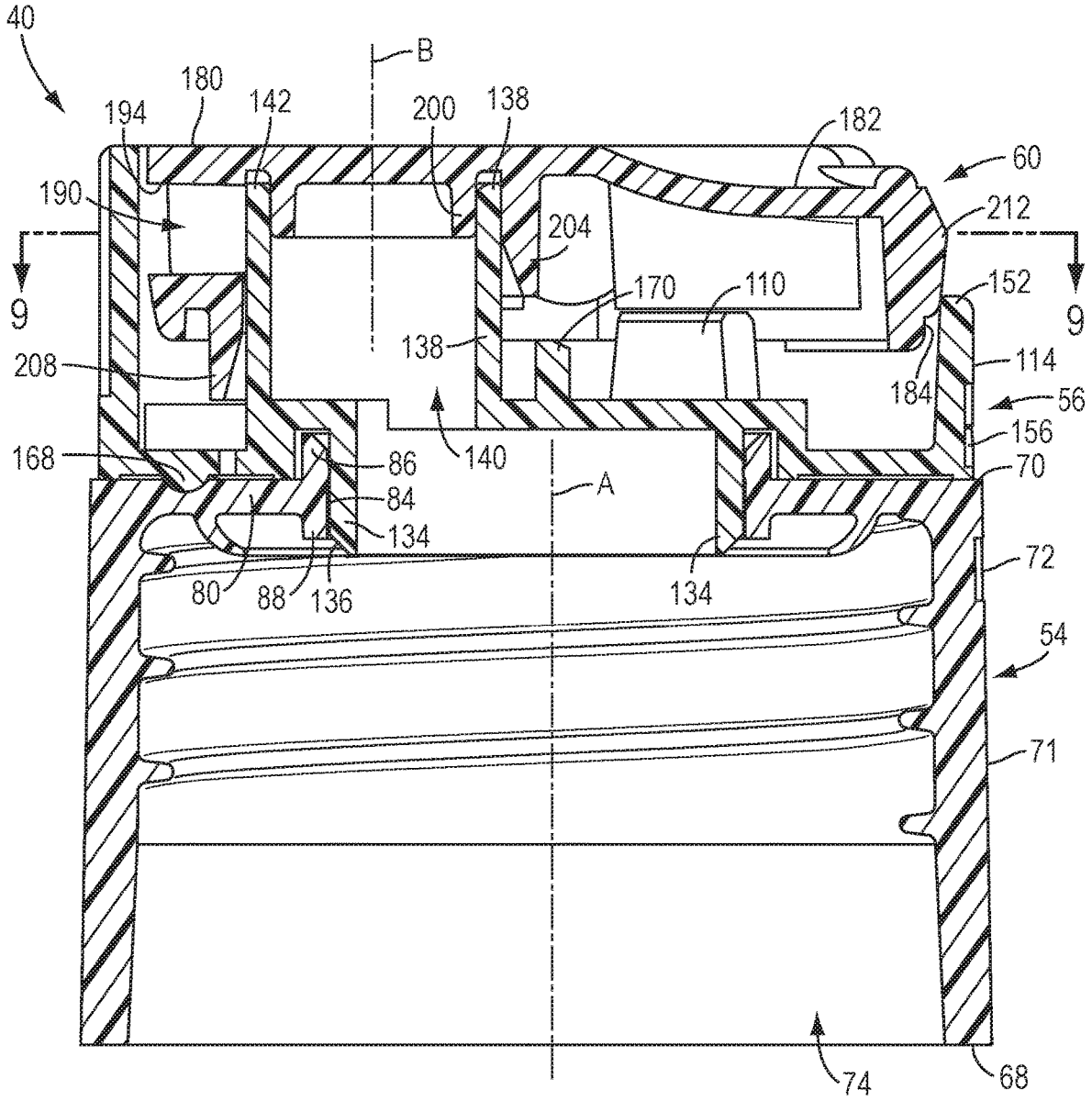
FIG. 8 is a cross-sectional view of the closure illustrated in FIG. 7, taken generally along the plane 8-8 in FIG. 7.
Figure 11:
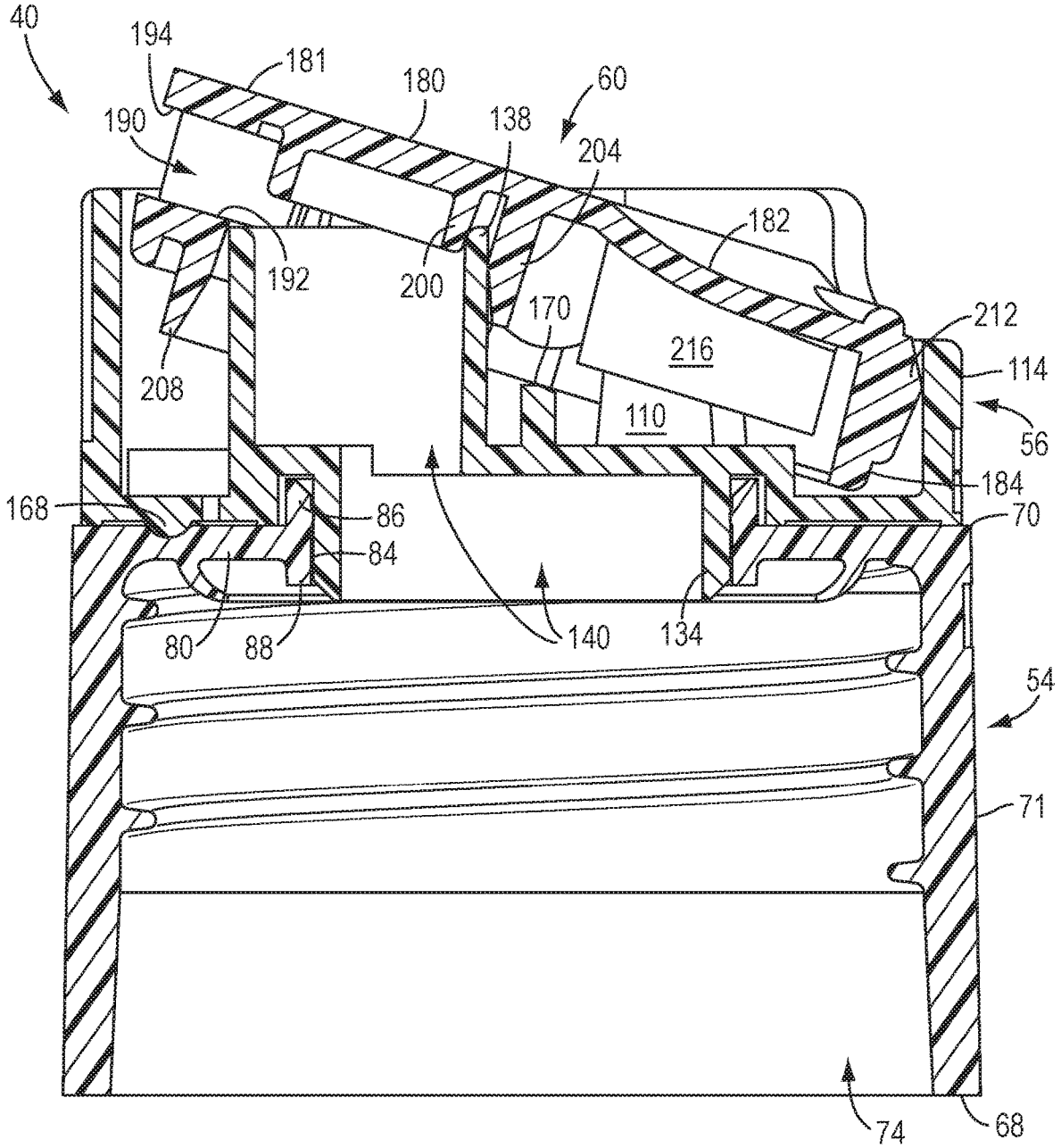
FIG. 11 is a cross-sectional view of the closure illustrated in FIG. 10, taken generally along the plane 11-11 in FIG. 10.

Referring now particularly to FIG. 26, as well as to FIGS. 2 and 5, the closure body wall 71 terminates at a top deck 80 at the upper end 70. The top deck 80 has an exterior surface or upper surface 82. As can be seen in FIGS. 2 and 26, the top deck 80 further has a circular, central hole or aperture 84 (FIGS. 2 and 26). As can be seen in FIG. 26, the aperture 84 opens to (i.e., communicates with) the interior of the closure body 54 which defines the inlet passage 74 (FIG. 11). With reference to FIGS. 8 and 11, the aperture 84 in the closure body deck 80 is defined in part by (1) a circular, upwardly-extending rim or wall 86 having a radially-inwardly extending bead 87 thereon, and (2) a circular, downwardly-extending rim or wall 88. Each of the walls 86 and 88 assists in retaining an annular mating feature of the locking member 56 within the aperture 84, the details of which are discussed below.

While the closure body 54 is illustrated as having a generally cylindrical structure, it will be appreciated, however, that the closure body 54 may take a variety of forms, and need not be limited to a cylindrical shape and need not have circular cross-sections as shown. For example, the lower end 68 and/or the upper end 70 may be elliptical, polygonal, or some irregular shape.

Referring to FIGS. 2 and 26, the upper surface 82 of the top deck 80 is provided with a pair of hemispherical recesses 90 therein, which are spaced apart along a circumference centered on the central rotational axis "A". The hemispherical recesses 90 accommodate a mating protrusion on the locking member 56 discussed hereinafter to generate or produce an audible and/or tactile indication to a user of the closure 40 when the locking member 56 is rotated with respect to the closure body 54. As seen in FIGS. 2 and 26, three generally arcuate lugs or retaining projections 94 are circumferentially spaced apart and extend upwardly from the upper surface 82 of the top deck 80. As discussed hereinafter, the three retaining projections 94 fit into mating arcuate slots within the locking member 56 to retain or hold the locking member 56 to the closure body 54. As best shown in FIG. 28, each one of the retaining projections 94 terminates in a radially-outwardly extending flange 98 defining a flat lower surface 102 and a frusto-conical, sloping upper surface 106, the function of which will be discussed in detail hereinafter.

While three retaining projections 94 are provided for mating with (i.e., being received in) three arcuate slots in the locking member 56 in the illustrated first embodiment of the closure 40, it will be understood that more or fewer retaining projections 94 and mating slots may be provided to either increase or decrease, respectively, the rigidity of the connection holding together the locking member 56 to the closure body 54.

With reference to FIGS. 2, 5, and 26, the closure body 56 is further provided with an arcuate locking tab or abutment 110 extending upwardly from the upper surface 82 of the top deck 80. The abutment 110 serves to contact a mating feature of the actuator 60 to prevent the actuator 60 from moving into an open, dispensing position when the locking member 56 is in a locking position as will be discussed below. The abutment 110 extends axially outwardly beyond the three retaining projections 94, and extends through a unique, larger arcuate aperture within the locking member 56 as discussed hereinafter.

Figure 27:
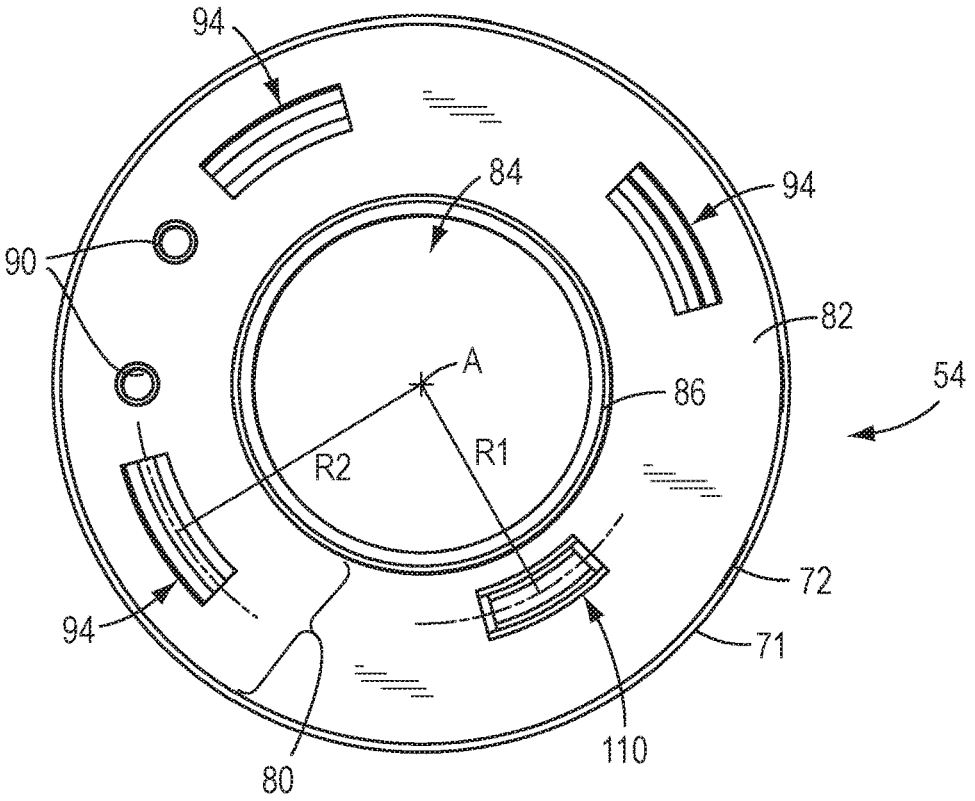
FIG. 27 is a top plan view of the closure body shown in FIG. 2.

As can be seen in FIG. 27, when the closure body 54 is viewed from above, the radially innermost portion of each projection defines an arc of a circle, and the radially innermost portion of the abutment 110 defines an are of a circle. The interior radius of curvature "R1" of the abutment 110 is less than the interior radius of curvature "R2" of each of the three retaining projections 94. Furthermore, it can be seen in FIG. 27 that each one of the three retaining projections 94 and the abutment 110 lie within a different quadrant of the closure body 54, when the closure body 54 is viewed from above. The shorter radius of curvature "R1" assists in preventing undesirable interference between the abutment 110 and the actuator 60 when the locking member 56 is rotated into the unlocked position, as will be discussed in detail hereinafter.

With reference to FIGS. 19-22, the locking member 56 is generally ring-shaped and has an annular, outer wall 114, a generally annular, bottom deck 118 that extends radially inwardly from the bottom portion of the outer wall 114, and a raised central deck 119 (FIG. 5). The bottom deck 118 of the locking member 56 defines a top surface 120 (FIGS. 19 and 21) facing toward the actuator 60 (FIG. 2) and a bottom surface 121 (FIGS. 20 and 22) facing toward the closure body 54 (FIG. 2). The bottom deck 118 is further provided with three arcuate retention slots 122 (FIGS. 20-22) therein. Each slot 122 receives a separate one of the closure body retaining projections 94 (FIG. 2). As best illustrated in FIG. 5, when the locking member 56 is assembled together with the closure body 54, the projections 94 extend through the slots 122 such that the lower surface 102 of each locking projection flange 98 extends radially outwardly over, and confronts, the upper surface 120 of the locking member bottom deck 118.

Figure 20:
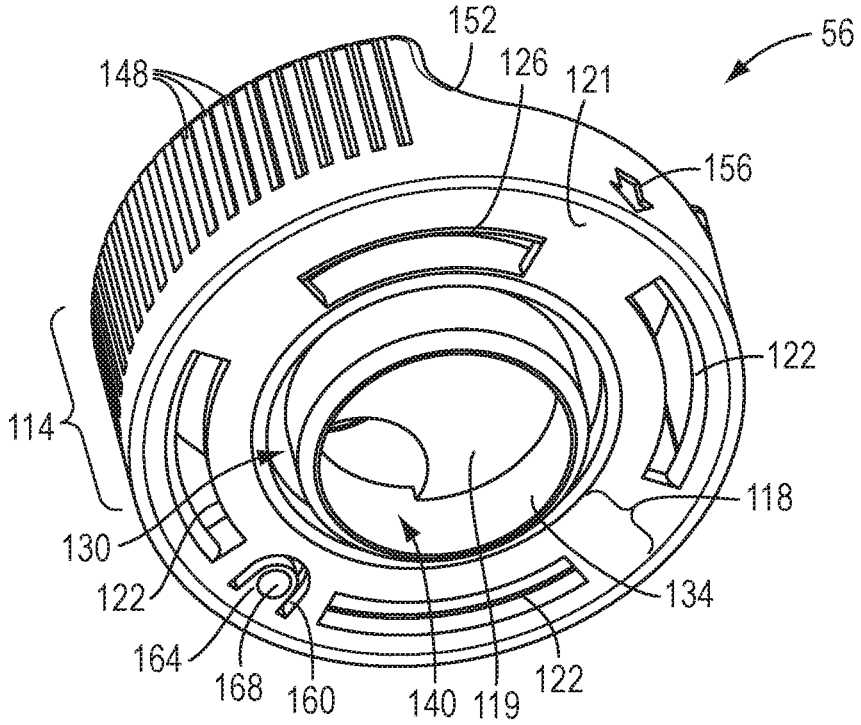
FIG. 20 is a perspective view, taken from below, of the locking member illustrated in FIG. 2.
Figure 21:
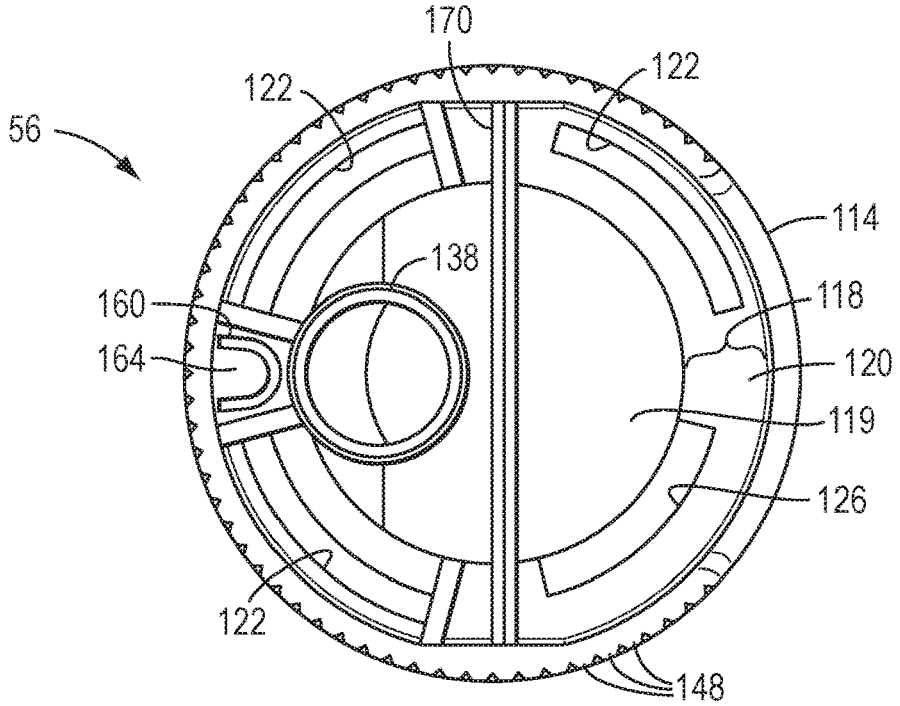
FIG. 21 is a top plan view of the locking member shown in FIG. 2.

With reference to FIGS. 20 and 21, the bottom deck 118 of the locking member 56 is further provided with an arcuate aperture 126 to receive the abutment 110 (FIG. 5) when the locking member 56 is assembled together with the closure body 54 (FIG. 5). The shape of the aperture 126 accommodates the travel of the abutment 110 though an arc of about 30 degrees, with respect to axis "A", when the locking member 56 is rotated relative to the closure body 54 between a locking position (FIG. 3) and an unlocking position (FIG.

7). The aperture 126 is larger than the slots 122 to ensure proper assembly of the locking member 56 together with the closure body 54.

Figure 22:
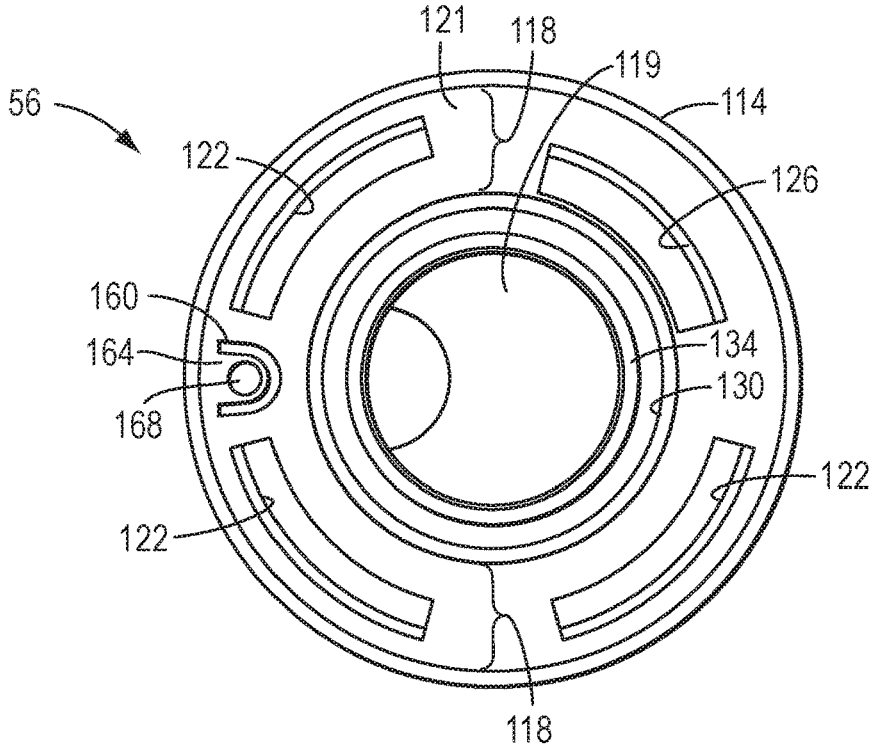
FIG. 22 is a bottom plan view of the locking member shown in FIG. 2.
Figure 23:
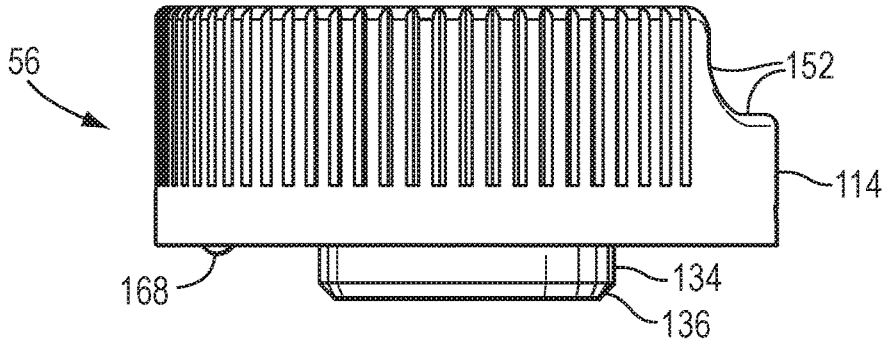
FIG. 23 is a right side elevation view of the locking member shown in FIG. 2.
Figure 24:
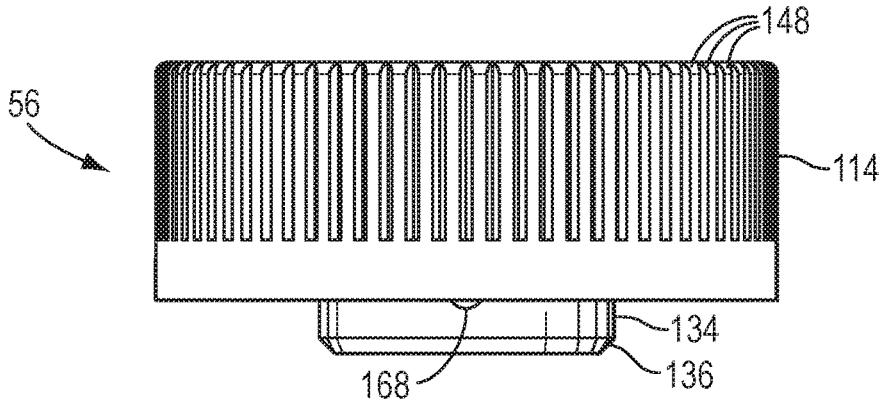
FIG. 24 is a front elevation view of the locking member shown in FIG. 2.
Figure 25:
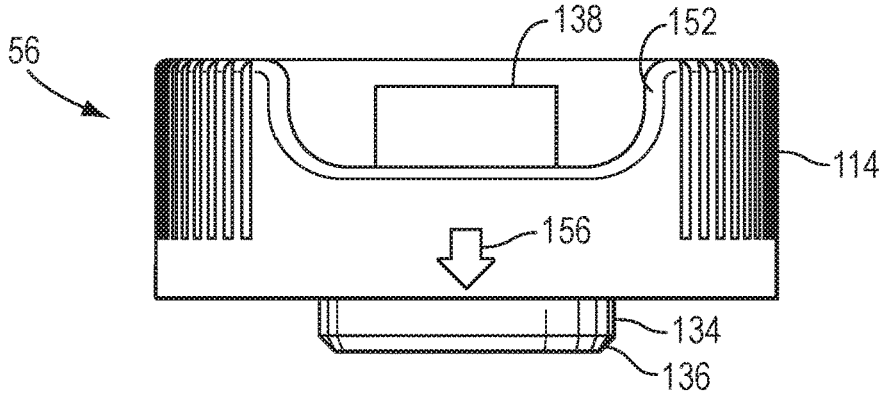
FIG. 25 is a rear elevation view of the locking member shown in FIG. 2.

As can be seen in FIGS. 20 and 22, radially inwardly of the bottom deck 118 of the locking member 56 there is an annular recess or channel 130 which surrounds a downwardly-extending annular wall 134. When the locking member 56 is assembled together with the closure body 54 (FIG. 2), the annular channel 130 functions to receive the annular, upwardly-extending wall 86 (FIG. 5) of the closure body 54 while the annular wall 134 of the locking member 56 fits within the closure body flow aperture 84 (FIG. 2) defined by the closure body annular walls 86 and 88 (FIG. 5). As illustrated in FIG. 5, the locking member annular wall 134 engages the bead 87 (FIG. 26) on the interior surface of the closure body wall 86 to form a liquid-tight, sliding seal. The wall 134 is provided with a tapered end surface 136 to assist in seating of the wall 134 within the aperture 84 during assembly of the components by the manufacturer.

With reference to FIG. 8, the locking member 56 includes a cylindrical spout 138 that extends upwardly from the deck 118. The upwardly extending spout 138 and the downwardly extending annular wall 134 together define an intermediate flow passage 140 that extends through both the spout 138 and the wall 134. The spout 138 is centered on an axis "B" (FIGS. 5 and 8) that is offset from the central axis "A" about which the wall 134 is centered. As will be discussed in detail hereinafter, the fluent substance (from the outlet end of the container 44 within the inlet passage 74 of the closure body 54 (FIG. 5)) flows through the closure body 54 and into the locking member 56 through the intermediate flow passage 140.

Figure 6:
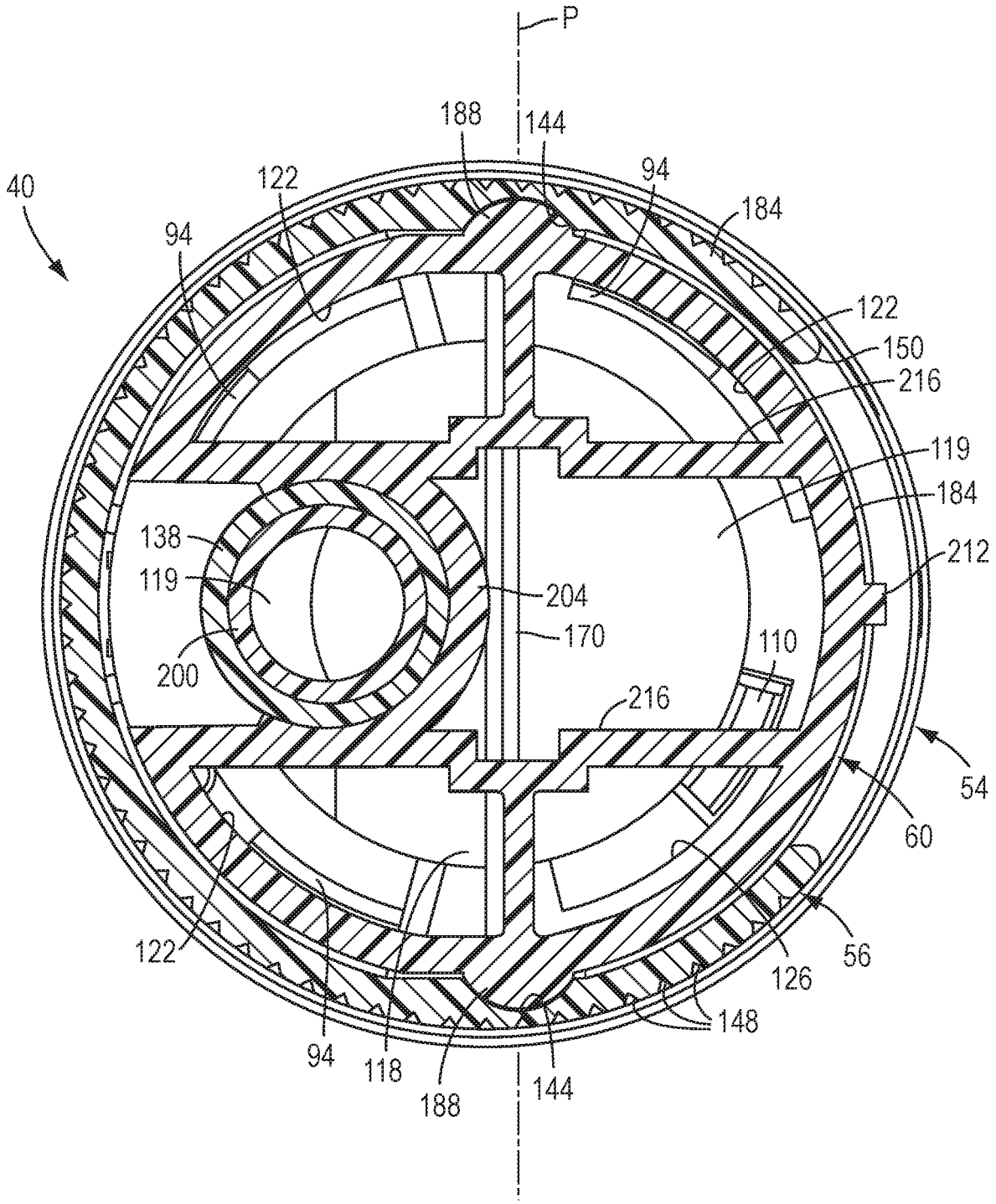
FIG. 6 is a cross-sectional view of the closure illustrated in FIG. 1, taken generally along the plane 6-6 in FIG. 5.
Figure 19:
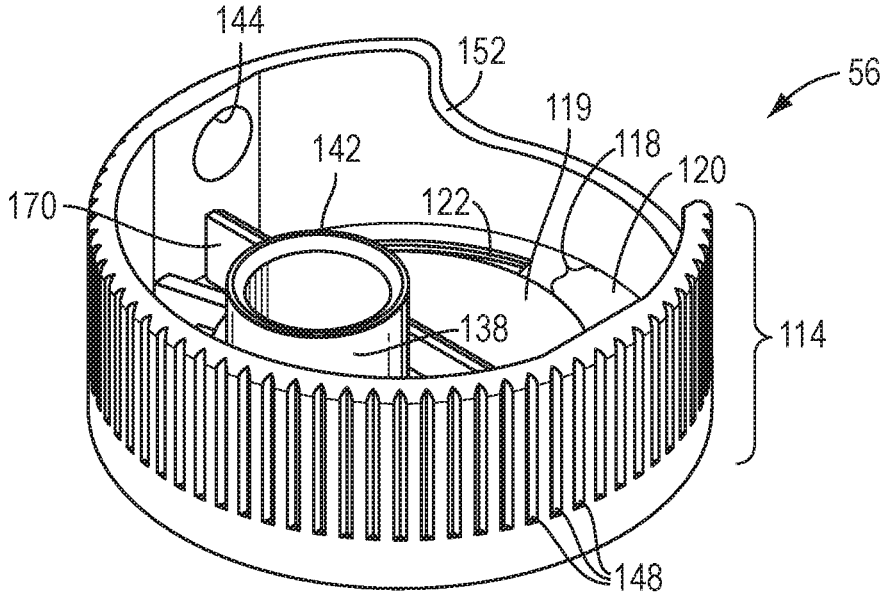
FIG. 19 is a perspective view, taken from above, of the locking member of the dispensing closure illustrated in FIG. 2.

As shown in FIGS. 2, 6, and 19, the inside of the annular wall 114 of the locking member 56 is provided with a pair of opposing detents or hemispherical recesses 144 that serve to retain mating hemispherical protrusions or trunnions formed on oppositely-facing sides of the actuator 60 as discussed in detail below.

As can be seen in FIGS. 2, 7, 19, and 21, the external surface of the locking member annular wall 114 has a plurality of axially-extending channels 148 therein for enhancing the friction between a user's fingers (e.g., thumb and forefinger) and the surface of the locking member 56 during the locking and unlocking rotation of the closure 40. A rear portion of the wall 114 includes a cut-away or recessed area 152 (FIGS. 2, 3, 7, and 19) to accommodate a user's finger (e.g., thumb or forefinger) during actuation of the actuator 60, as will be discussed herein. Other types of friction-enhancing means may be utilized, in place of the channels 148, such as providing the wall 114 with surface roughening, finger recesses, raised beads, etc.

Figure 7:
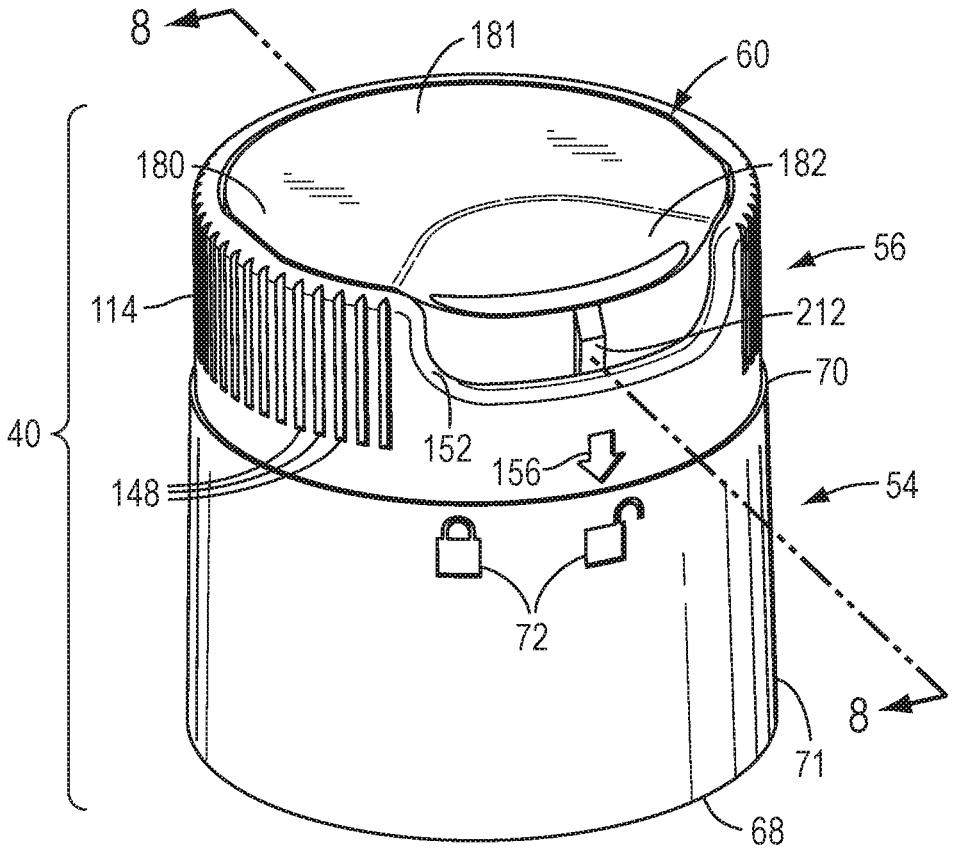
FIG. 7 is a perspective view similar to FIG. 3, however in FIG. 7 the locking of the closure has been rotated counter-clockwise relative to the closure body into an unlocked position.

With reference to FIGS. 3 and 7, the annular wall 114 of the locking member 56 has an indicium 156 in the form of an arrow pointing toward the closure body 54. The indicium 156 is located on the annular wall 114 such that the arrow points either toward the unlocked or locked indicia 72 on the closure body 54 at the two limits of relative rotation between the locking member 56 and the closure body 54, thus indicating to a user of the closure 40 the unlocked or locked status of the closure 40.

As can be seen in FIGS. 20, 21, and 22, a U-shaped cut aperture or through hole 160 is provided within the annular bottom deck 118 to define a radially-inwardly extending projection 164 (FIG. 21). The projection 164 has a downwardly-extending bump or hemispherical bead 168 (FIGS. 20 and 22) formed thereon. During relative rotation between the locking member 56 and the closure body 54 about central rotational axis "A", the bead 168 moves with respect to the closure body recesses 90 (FIG. 26) to produce an audible and/or tactile signal for the user of the closure 40. The particular details of operation of this audible and/or tactile signal mechanism are discussed hereinafter.

Referring to FIGS. 19 and 21, the locking member 56 includes a central rib 170 that bisects the locking member 56 when viewed from above. The central rib 170 extends between opposite sides of the annular wall 114, beneath the hemispherical recesses 144 (FIG. 2). The central rib 170 strengthens the locking member 56 and also functions to support the actuator 60 during pivoting movement of the actuator 60 with respect to the locking member 56, and to prevent undesirable vertical movement of the locking member 56 with respect to the actuator 60 during pivoting thereof, as will be discussed in detail hereinafter.

As shown in FIGS. 12-18, the actuator 60 has a generally disc-like shape with a substantially flat top end 180 with a front region 181 and a recessed or sloping back region 182 designed to accommodate the finger of a user of the closure 40 during opening of the actuator 60. The actuator 60 has an annular side wall 184 with a pair of semispherical protrusions 188 spaced 180 degrees apart from one another. Each one of the protrusions 188 fits within one of the recesses 144 (FIG. 6) in the locking member 56 (FIG. 6) to define a pivot axis "P" (FIG. 6) about which the actuator 60 may pivot with respect to the locking member 56, the operation of which is discussed hereinafter.

Figure 12:
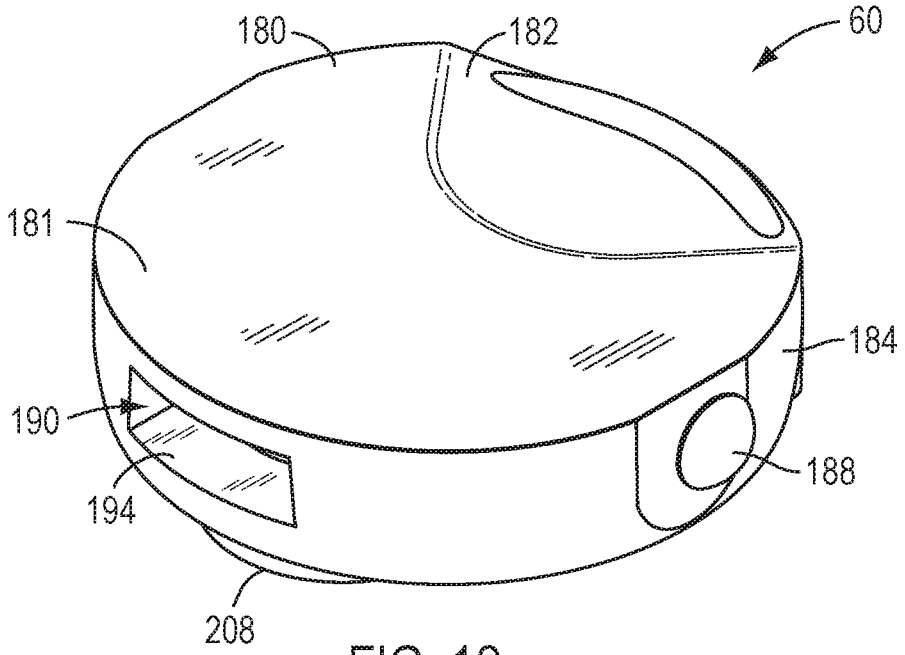
FIG. 12 is a perspective view, taken from above, of the actuator of the dispensing closure illustrated in FIG. 2.
Figure 13:
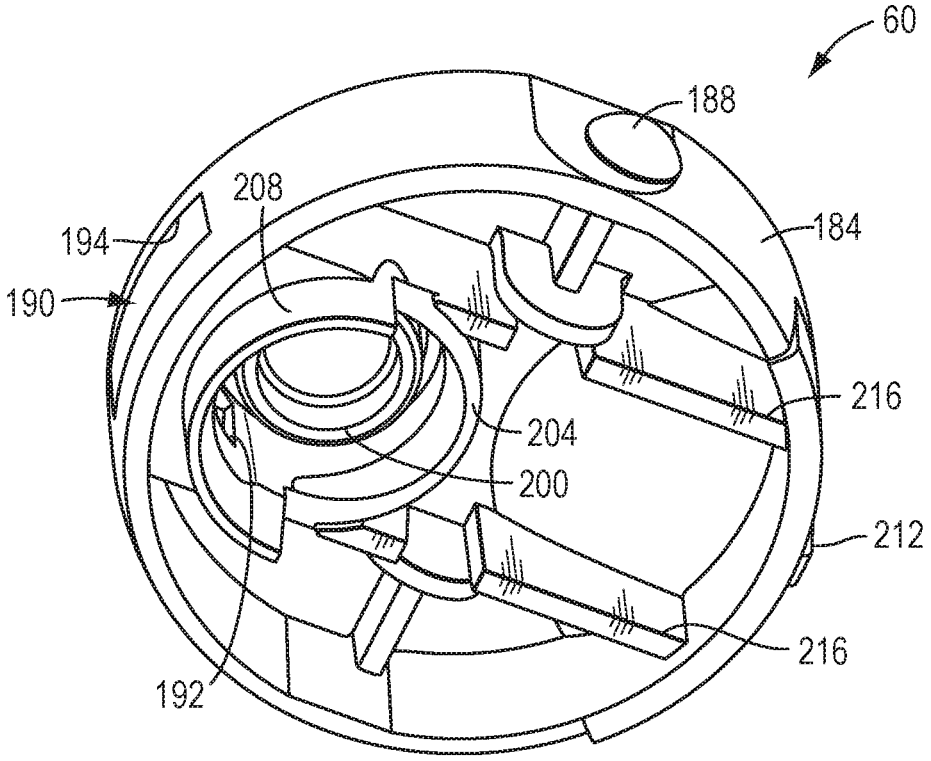
FIG. 13 is a perspective view, taken from below, of the actuator of the dispensing closure illustrated in FIG. 2.
Figure 14:
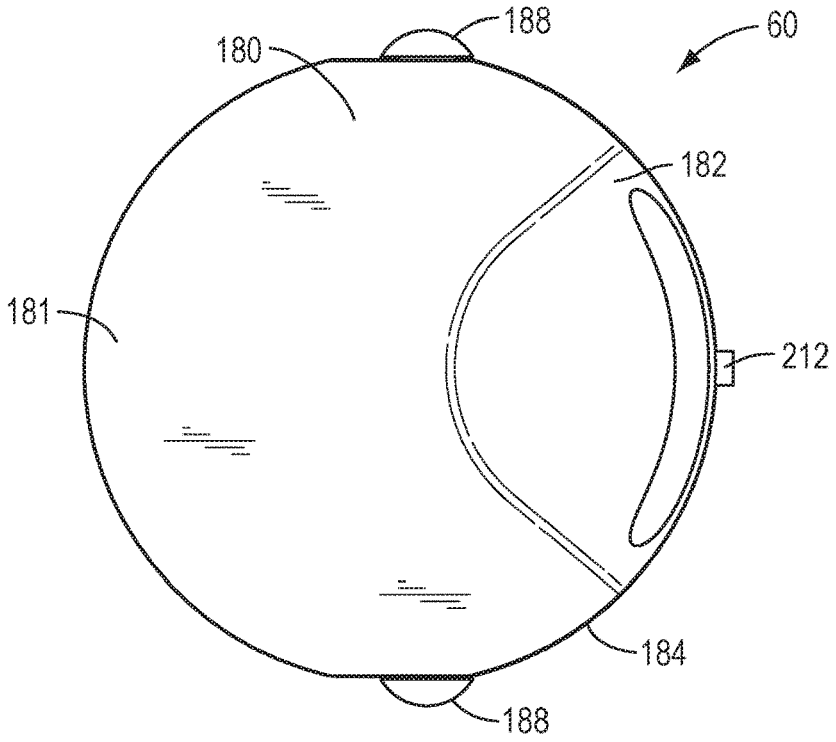
FIG. 14 is a top plan view of the actuator shown in FIG. 2.
Figure 15:
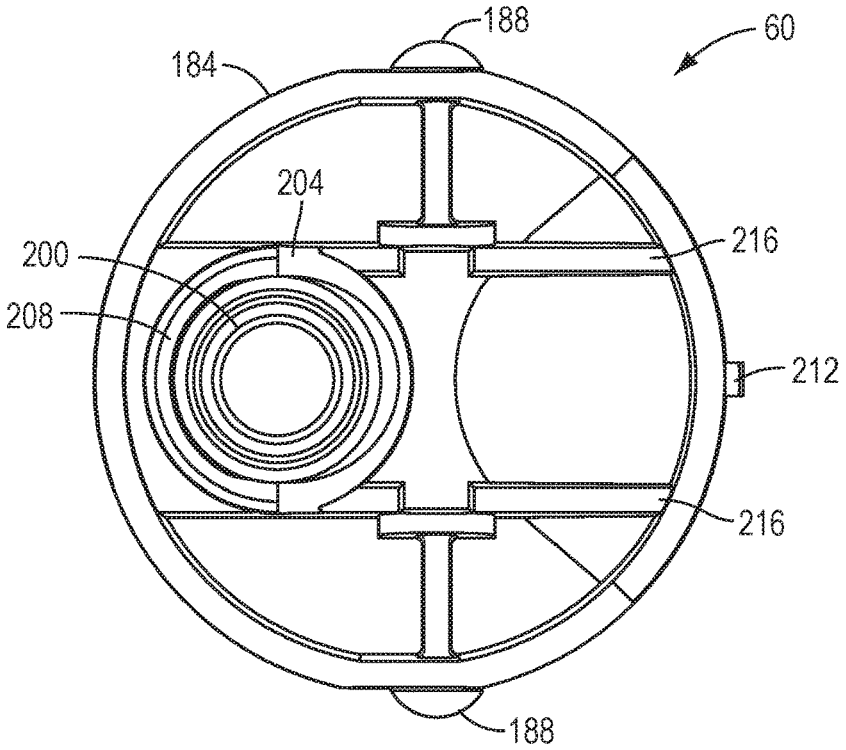
FIG. 15 is a bottom plan view of the actuator shown in FIG. 2.
Figure 16:
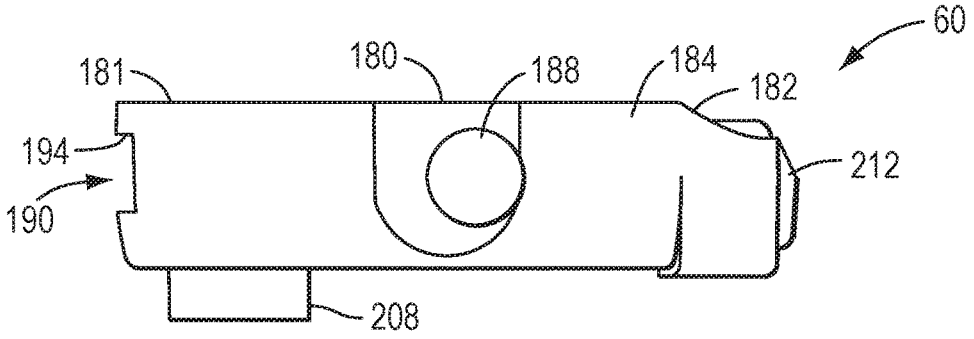
FIG. 16 is a right side elevation view of the actuator shown in FIG. 2.
Figure 17:
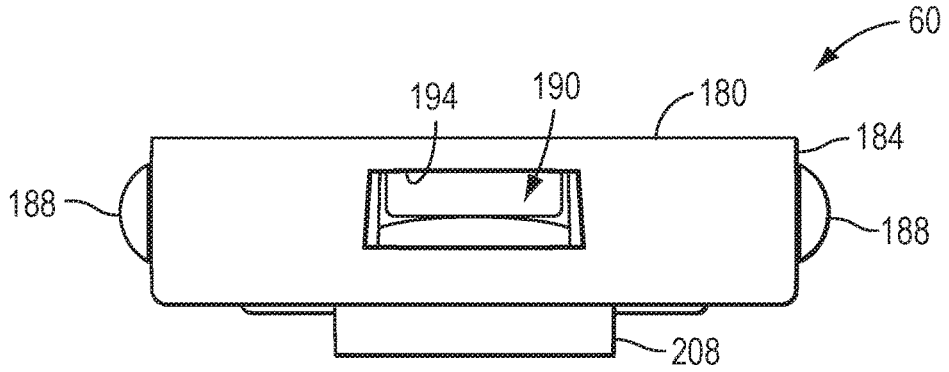
FIG. 17 is a front elevation view of the actuator shown in FIG. 2.
Figure 18:
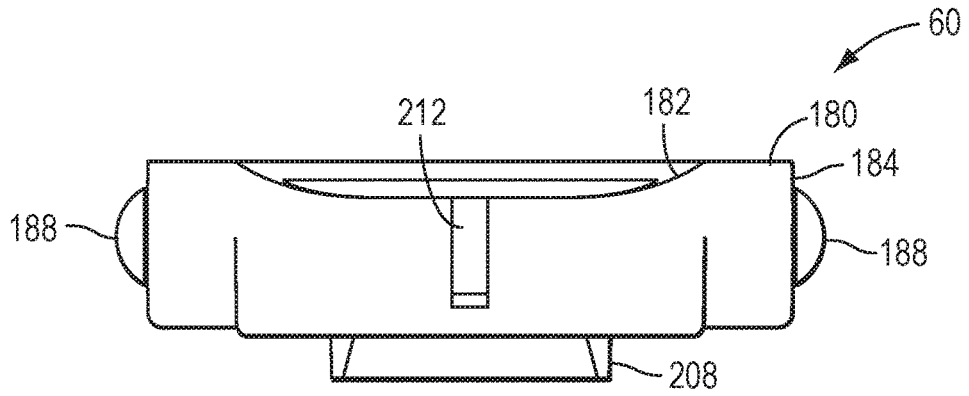
FIG. 18 is a rear elevation view of the actuator shown in FIG. 2.

As illustrated in FIGS. 11, 12, and 13, the actuator 60 is provided with a dispensing flow passage 190 having an inlet end 192 (FIG. 13) and an outlet end 194 (FIG. 12) on the exterior of the actuator 60. The actuator dispensing flow passage 190 may be selectively placed into communication with the intermediate flow passage 140 (FIG. 11) of the locking member 56 (FIG. 11) when the actuator 60 is pivoted from a closed position (FIG. 8) to an open position (FIG. 11) by a user of the closure 40. As seen in FIGS. 12, 13, and 15-18, the actuator 60 has a plug or internal annular wall 200 that extends downwardly therefrom to seal against the inside of the spout 138 (FIG. 8) when the actuator 60 is in the closed position (FIG. 8). A first semi-circular sealing rim 204 and a second semi-circular sealing rim 208 extend downwardly in the actuator 60 to maintain a fluid tight seal between the locking member spout 138 and the actuator 60 such that the outlet end 194 of the dispensing flow passage 190 is the only path of egress for a fluent substance when the actuator 60 is in the open position (FIG. 11).

With reference to FIGS. 3, 8, and 11, the annular side wall 184 of the actuator 60 has a wedge-shaped projection or cam element 212 extending therefrom. As shown in FIGS. 8 and 11, the cam element 212 is located at the back (i.e., rear) end of the actuator 60 adjacent the sloping back region 182 and functions to frictionally engage the inside of the locking member annular wall 114. The frictional engagement of the cam element 212 with the locking member wall 114 functions to stabilize the actuator 60 to maintain the actuator 60 in both the open and closed positions with respect to the locking member 56 after the user has pivoted the actuator 60 to the desired open or closed position.

As shown in FIGS. 5, 6, 9, and 13, the actuator 60, which is carried by the rotatable locking member 56, has a pair of ribs or abutments 216 extending downwardly from the underside of the top end 180. When the locking member 56 is in the locking position relative to closure body 54 (FIGS. 3, 5, and 6), one of the two abutments 216 of the actuator 260 is located directly above the abutment 110 of the closure body 54. In the locking position of the locking member 56, the upwardly-extending abutment 110 of the closure body 54 prevents any appreciable downward movement of the back end of the actuator 60 (as best illustrated in FIG. 5) to prevent a user of the closure 40 from placing the actuator 60 into the open position. When the locking member 56 is rotated into the unlocking position (FIGS. 7, 8, and 9), about 30 degrees away from the locked position, the one abutment 216 of the actuator 60 is no longer located directly above the abutment 110 of the closure body 54 (as best illustrated in FIG. 11). When the locking member 56 (and actuator 60 carried therein) are in the unlocking position, the upwardly-extending abutment 110 of the closure body 54 is no longer in the downward path of the either of the abutments (ribs) 216 of the actuator 60 so that the actuator 60 can be pivoted into the open position by a user of the closure 40, as discussed fully hereinafter.

One method of assembling the components of the closure 40 is next discussed with initial reference to FIG. 2. It will be understood that the method of assembly described herein is illustrative only, and there may be other methods of assembling the components of the closure 40. The actuator 60 and the locking member 56 may be assembled by first orienting the recesses 144 in the annular wall 114 of the locking member 56 with the hemispherical projections 188 of the actuator 60 such that the sloping back region 182 of the actuator 60 is located proximal to the recessed area 152 of the wall 114. The actuator 60 and locking member 56 may be subsequently brought together along axis "A" until the hemispherical projections 188 are pressed into the two the recesses 144, such that the actuator 60 is oriented in the closed, non-dispensing position. As can be seen in FIG. 8, the plug 200 seals against the inside of the spout 138 when the actuator 60 is assembled with the locking member 56 and oriented in the non-dispensing, closed position. One or both of the components (locking member 56 and actuator 60) are sufficiently resilient to accommodate the assembly of the two components.

With reference to FIG. 6, the subassembly of the actuator 60 and locking member 56 may then be oriented adjacent the closure body 54 such that the aperture 126 (FIG. 6) in the bottom deck 118 of the locking member 56 overlies the abutment 110 of the closure body 54. In this orientation, each one of the arcuate slots 122 of the locking member 56 also overlies a respective one of the retaining projections 94 of the closure body 54. Then, with reference to FIG. 5, the closure body 54 and the subassembly of the actuator 60 and locking member 56 are pressed together along axis "A" such that the annular wall 134 of the locking member 56 sealingly engages the bead 87 on the interior surface of the upwardly-extending wall 86 of the closure body 54. As the subassembly of the actuator 60 and locking member 56 is brought together with the closure body 54, the upwardly-extending wall 86 of the closure body 54 is received within the channel 130 of the locking member 56. The abutment 110 extends through the aperture 126, followed by the deflection of the retaining projections 94 as they are snap-fit into the arcuate slots 122 to retain the closure body 54 together with the subassembly of the actuator 60 and locking member 56. While not illustrated, an additional snap-fit bead may be provided on the abutment 110 to improve the rigidity of the connection between the closure body 54 and the locking member 56. Alternatively, the locking member 56 and body 54 may be assembled initially as a subassembly, and then subsequently combined with the actuator 60.

The detailed operation and function of the closure 40 will next be described with initial reference to FIG. 1. Typically, a user will encounter the closure 40 as shown in FIG. 1, with the closure 40 installed upon the top end 46 of a container 44 of a fluent substance—the closure 40, container 44, and fluent substance within the container 44 together defining a package. A removable adhesive, tape, or plastic wrap (not illustrated) may optionally be provided over the top of the actuator 60 of the closure 40 for purposes of providing a redundant seal or tamper-evident feature. If such a seal or tamper evident feature is provided, the user would initially remove it from the closure 40 to expose the actuator 60 prior to initial operation of the closure 40.

The user would typically encounter the closure 40 as shown in FIG. 3, whereby the locking member 56 is oriented in the locking position and the actuator 60 is oriented in the non-dispensing, closed position. With the locking member 56 oriented in the locking position, the arrow indicium 156 of the locking member 56 points toward the locked indicium 72 (e.g., padlock as illustrated) of the closure body 54. Further, one of the closure body recesses 90 (FIGS. 2 and 27) receives the locking member bead 168. Also, with reference to FIGS. 5 and 6, when the locking member 56 is oriented in the locking position, one of the two abutments 216 of the actuator 60 is oriented to overlie, in a transverse orientation, the abutment 110 of the closure body 54. At this stage in operation of the closure 40, if the user attempts to move the actuator 60 from the closed position into the open position (e.g., by depressing the sloping back region 182 of the actuator 60 to cause the actuator 60 to pivot within the recesses 144 (FIG. 6) of the locking member 56), then the user would be prevented from doing so by contact of one of the actuator abutments 216 with the closure body abutment 110. The initially locking configuration of the locking member 56 and closed position of the actuator 60 prevents, or at least minimizes, the potential for accidental dispensing or spilling of the fluent substance if the package is accidentally inverted and/or perhaps accidentally impacted to create a slight increase in internal pressure.

Figure 9:
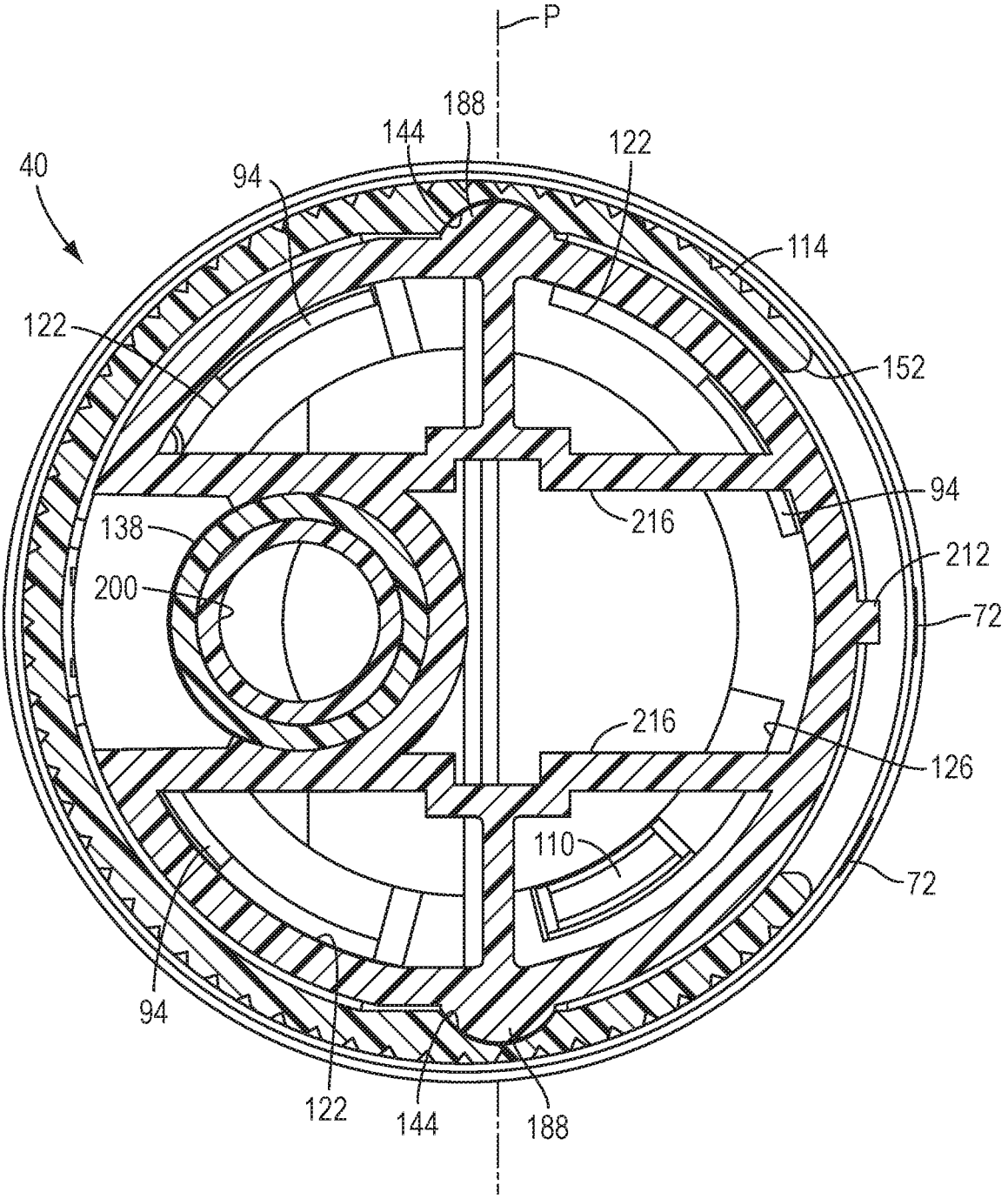
FIG. 9 is a cross-sectional view of the closure illustrated in FIG. 7, taken generally along the plane 9-9 in FIG. 8.

With reference to FIGS. 7, 8, and 9, the user begins to open the closure 40 to the dispensing configuration by first grasping the locking member 56 by the outer wall 114, while holding the closure body 54 and/or the container 44 (FIG. 1 only), and then twisting or rotating the locking member 56 relative to the closure body 54 from the locking position into the unlocking position. The rotation is about the central rotational axis A (FIG. 2), and the angle of rotation is about 30 degrees for the particular component configuration illustrated in the Figures. Rotation of the locking member 56 to the unlocking position causes the arrow indicium 156 (FIGS. 3 and 7) to point towards the unlocked indicium 72 of the closure body 54 as illustrated in FIG. 7. As can be seen by comparing FIG. 6 with FIG. 9, rotation of the locking member 56 from the locked position (FIG. 6) into the unlocked position (FIG. 9) moves the three locking member retention slots 122 along an arcuate path relative the closure body projections 94 received therein, and also moves the locking member aperture 126 in an arcuate path relative to the closure body abutment 110 received therein. Further, as the locking member 56 is rotated, the actuator 60 (which is mounted in the locking member 56) carries the rib abutments 216 to a moved position wherein neither of the abutments 216 is any longer located above the closure body abutment 110 (compare FIGS. 6 and 9).

Figure 29:
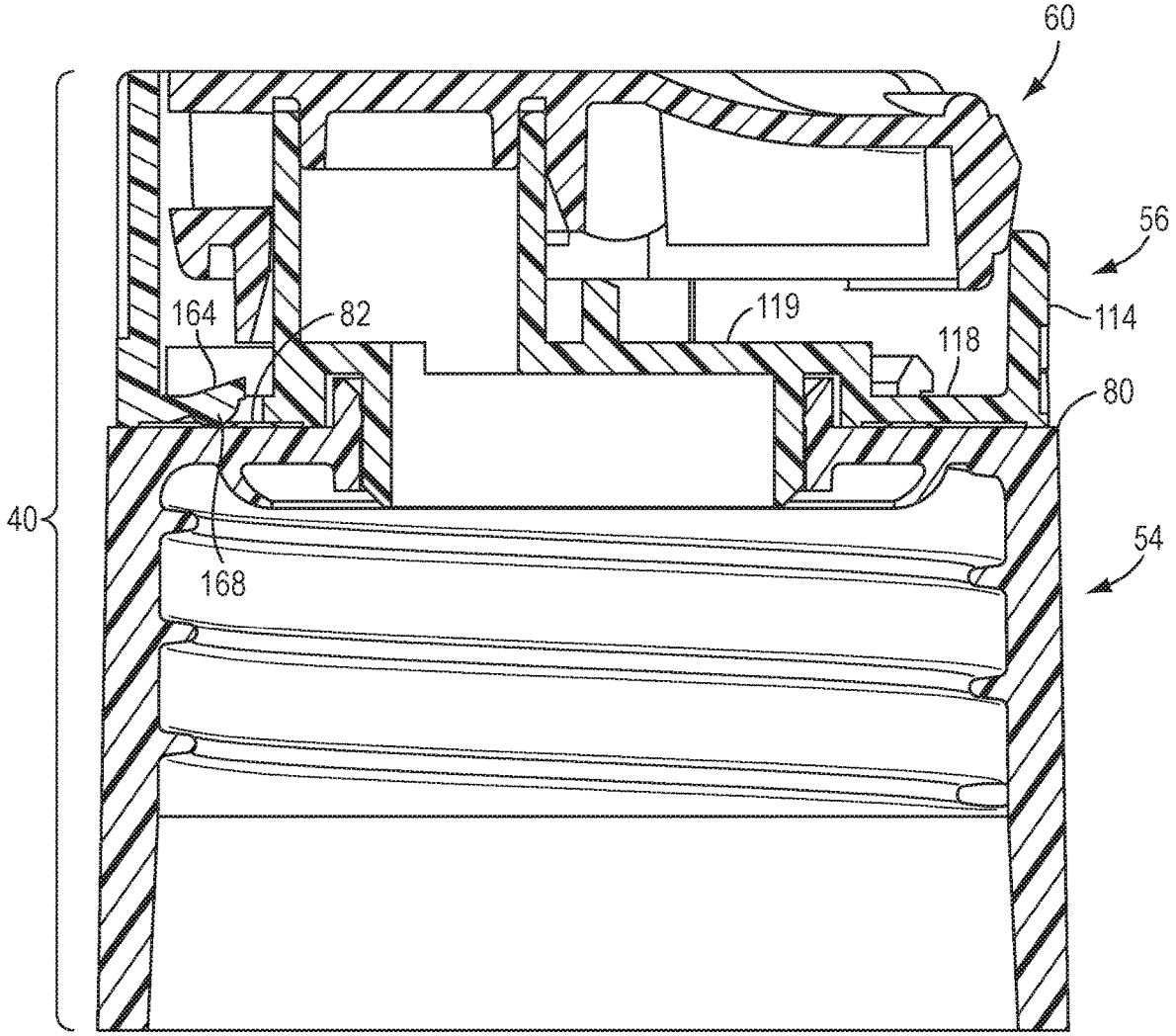
FIG. 29 is a similar view to FIG. 8, however
Figure 30:
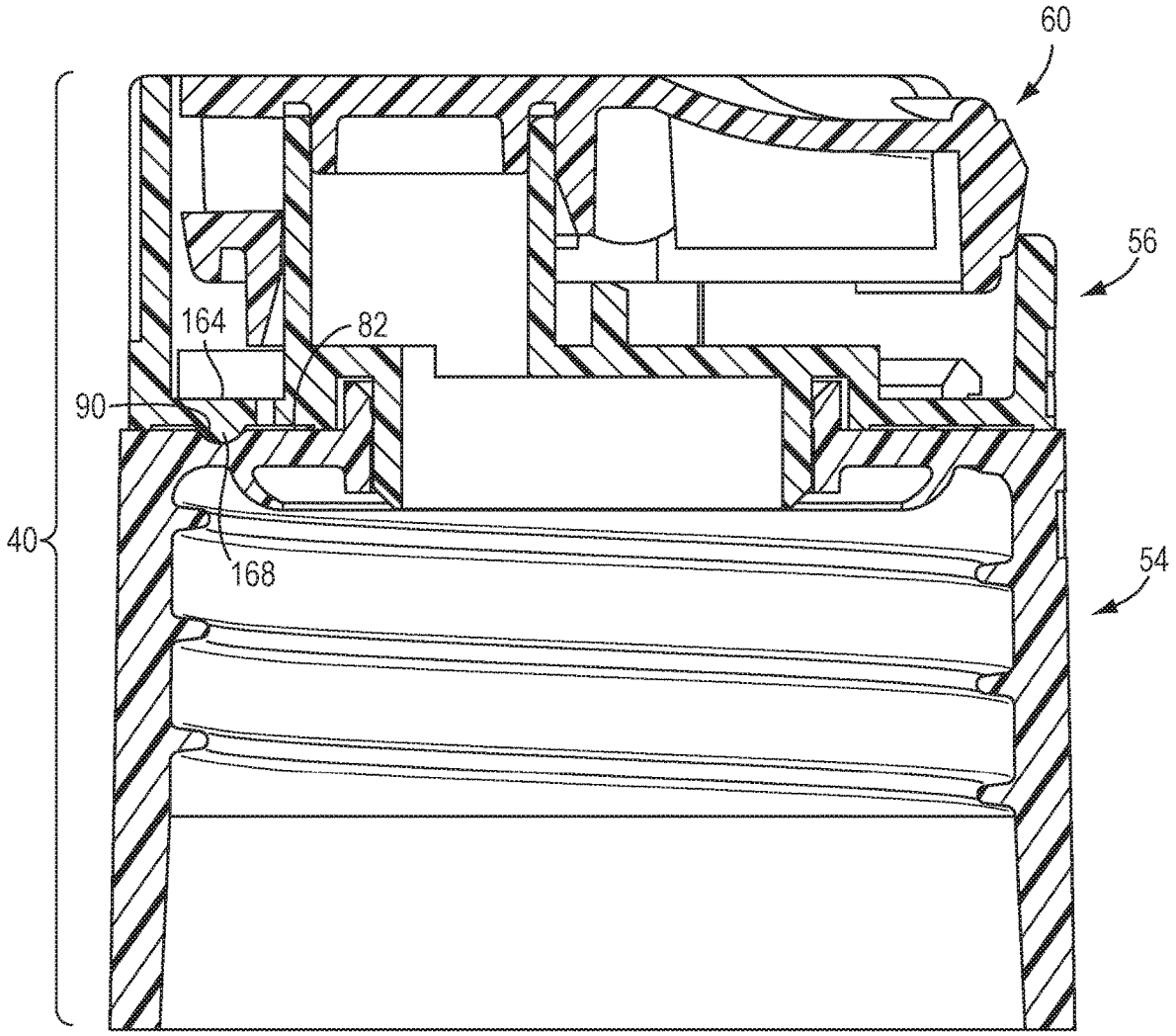
FIG. 30 is a similar view to FIG. 29, however in FIG. 30 shows the locking member rotated fully into the unlocking position shown in FIG. 8.

With reference to FIGS. 29 and 30, when the user initially begins to twist or rotate the locking member 56 relative to the closure body 54 counterclockwise from the locking position toward the unlocking position, the locking member hemispherical bead 168 is urged out of a first one of the closure body recesses 90 (FIG. 30 only) as the radially-extending projection 164 flexes upwardly from the resulting interference. Continued rotation of the locking member 56 relative to the closure body 54 causes the hemispherical bead 168 to slide along an arcuate path on the upper surface 82 of the closure body top deck 80 (FIG. 29 only). When the locking member 56 is fully rotated into the unlocked position, then the hemispherical bead 168 snaps into the second one of the closure body recesses 90. Release of potential energy and movement of the radially-extending projection 164 to an unstressed condition results in an audible and/or tactile indication to the user that the closure 40 is unlocked.

Referring to FIG. 9, with the actuator 60 in the unlocking position, both abutments 216 of the actuator 60 are clear of the abutment 110 of the closure body 54, such that the user may move the actuator 60 from the closed position into the open position by depressing the sloping back region 182 of the actuator 60 to cause the actuator 60 to pivot within the recesses 144 of the locking member 56. As the user presses on the sloping back region 182 of the actuator 60, the two hemi-spherical projections 188 rotate within the recesses 144 of the locking member 56 such that the actuator 60 pivots about the pivot axis "P".

Referring to FIG. 11, the cam element 212 slides down into the locking member 56 against the wall 114 when the actuator 60 moves into the open position. The cam element 212 stabilizes and maintains the actuator 60 in the open position by frictional engagement with the wall 114 of the locking member 56.

Still referring to FIG. 11, as the actuator 60 pivots open, the plug 200 lifts partially out of the spout 138 so that the outlet end 194 of the dispensing flow passage 190 is exposed to the ambient environment. The user may then grasp the flexible, resilient container 44 to collapse or otherwise reduce the internal volume of the container 44 to pressurize the fluent substance contained therein. In some situations, the user may also invert the container 44. In any event, during dispensing of the fluent substance, the fluent substance initially enters the inlet flow passage 74 of the closure body 54 and flows through intermediate flow passage 140 of the locking member 56, flows into the dispensing flow passage 190 of the actuator 60, and exits the closure 40 from the exposed outlet end 194.

When the user ceases to squeeze (i.e., pressurize) the container 44, the outward flow of the fluent substance is stopped and may even be sucked back toward the container 44 by a temporary lower pressure within the container 44 (e.g., if the container has resilient walls that return from a "squeezed in" configuration to the normal undeformed configuration). This allows some of the fluent substance within the dispensing flow passage 190, the intermediate flow passage 140, and/or the inlet flow passage 74 to be forced by the greater ambient air pressure back through the closure 40 and toward the container 44 to help maintain the overall cleanliness of the package.

Figure 10:
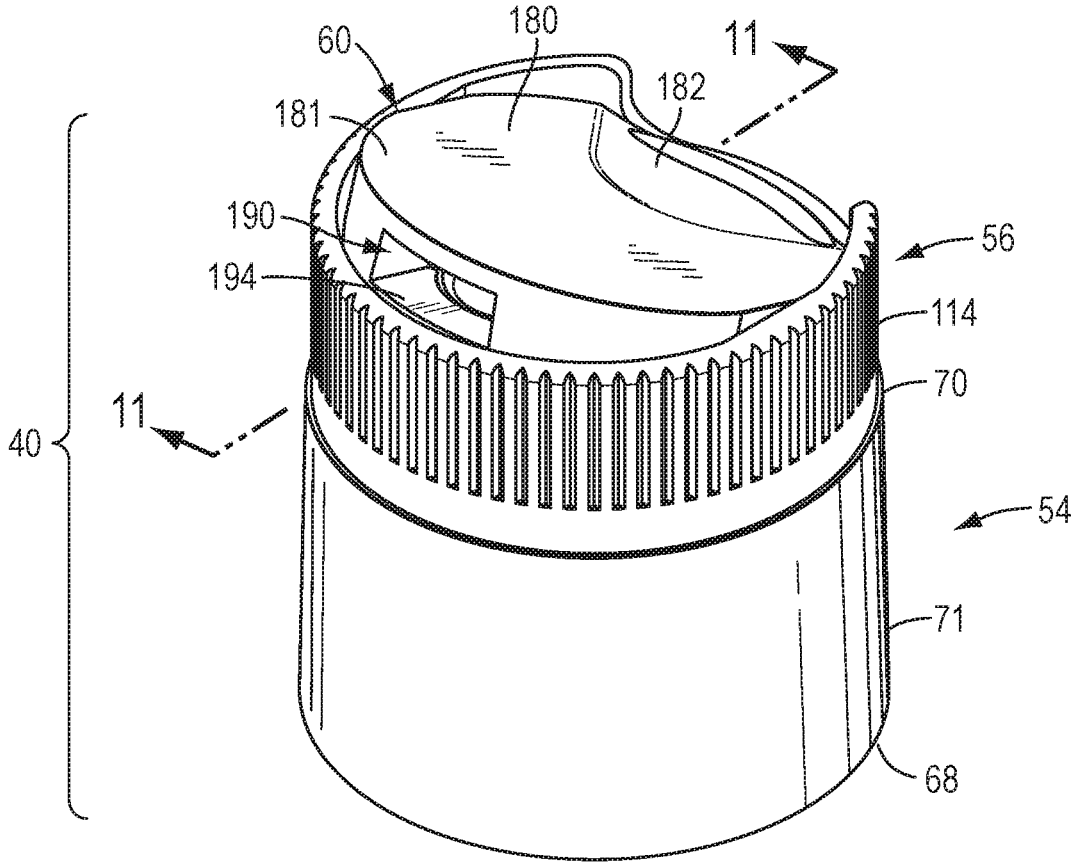
FIG. 10 is a similar perspective view of the closure shown in FIG. 1, however in FIG. 10 the actuator of the closure is has been rotated (i.e., pivoted or tilted) into an open, dispensing position.

Referring to FIGS. 10 and 11, the user may then move the actuator 60 from the open position into the closed position by depressing the front region 181 of the actuator 60 (which is located on the opposite side of the pivot axis "P" (FIG. 9) from the sloping back region 182) to cause the two hemispherical projections 188 (FIG. 9) to pivot within the recesses 144 (FIG. 9) of the locking member 56. The pivoting movement of the actuator 60 causes the plug 200 to re-seal within the spout 138 and also conceals the outlet end 194 of the dispensing flow passage 190 from the ambient environment.

With reference to FIGS. 3 and 7, the user may then grasp the locking member 56 by the outer wall 114 and twist or rotate the locking member 56 clockwise relative to the closure body 54 from the unlocking position back into the locking position. Rotation of the locking member 56 carries the arrow indicium 156 of the locking member 56 to the location where the arrow indicium 156 points toward the locked indicium 72 of the closure body 54.

As can be seen in FIGS. 6 and 9, rotation of the locking member 56 clockwise causes the three arcuate slots 122 to move relative to the three retaining projections 94 received within them, and further causes the arcuate aperture 126 to move relative to the closure body abutment 110. The actuator 60 rotates through an angle of about thirty degrees about the central rotational axis "A" (FIG. 2) between the unlocking position (FIG. 9) and the locking position (FIG. 6). With the locking member 56 oriented in the locking position, the abutment 216 of the actuator 60 overlies the abutment 110 of the closure body 54 (FIG. 6). If the user attempts to move the actuator 60 from the closed position into the open position (e.g., such as by depressing the sloping back region 182 of the actuator 60), then the user would again be prevented by contact of the abutment 216 of the actuator 60 with the abutment 110 of the closure body 54.

With reference to FIGS. 29 and 30, when the user rotates the locking member 56 clockwise relative to the closure body 54 from the unlocking position toward the locking position, the locking member hemispherical bead 168 is urged out the second one of the closure body recesses 90 (FIG. 26), and the radially-extending projection 164 flexes upwardly from the resulting interference. Continued rotation of the locking member 56 relative to the closure body 54 toward the locking position causes the hemispherical bead 168 to slide along an arcuate path on the upper surface 82 of the closure body top deck 80 (FIG. 29 only). When the locking member 56 is rotated fully into the locking position, then the hemispherical bead 168 snaps into the first one of the closure body recesses 90. Release of potential energy and movement of the radially-extending projection 164 to an unstressed condition results in an audible and/or tactile indication to the user that the closure 40 is locked.

Figure 31:
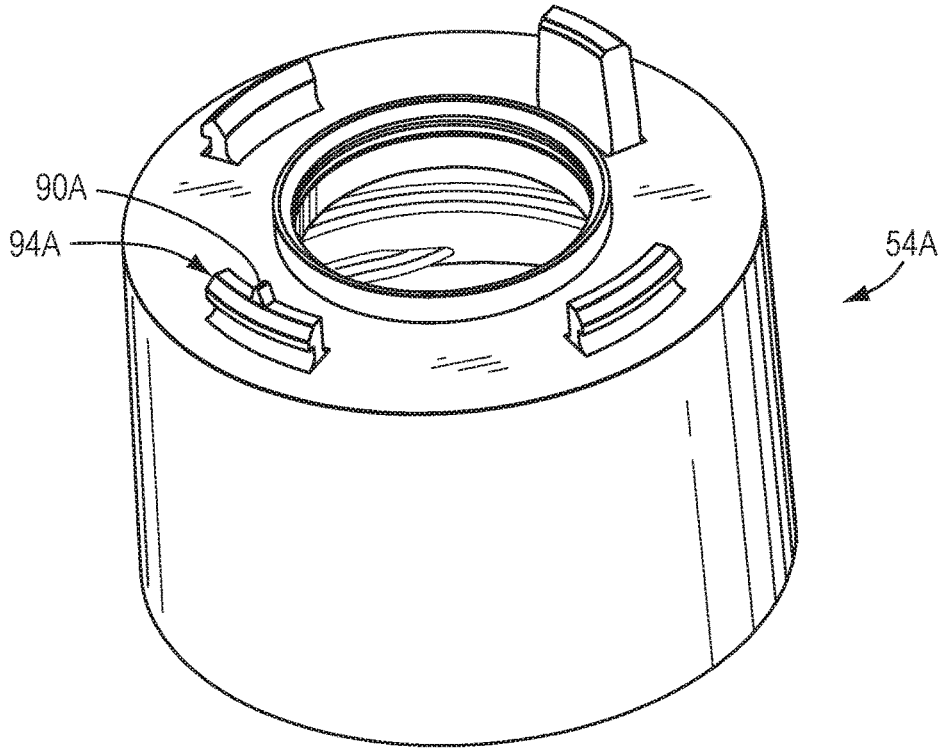
FIG. 31 is a perspective view, taken from above, a closure body of a second embodiment of a dispensing closure according to the present invention.
Figure 32:
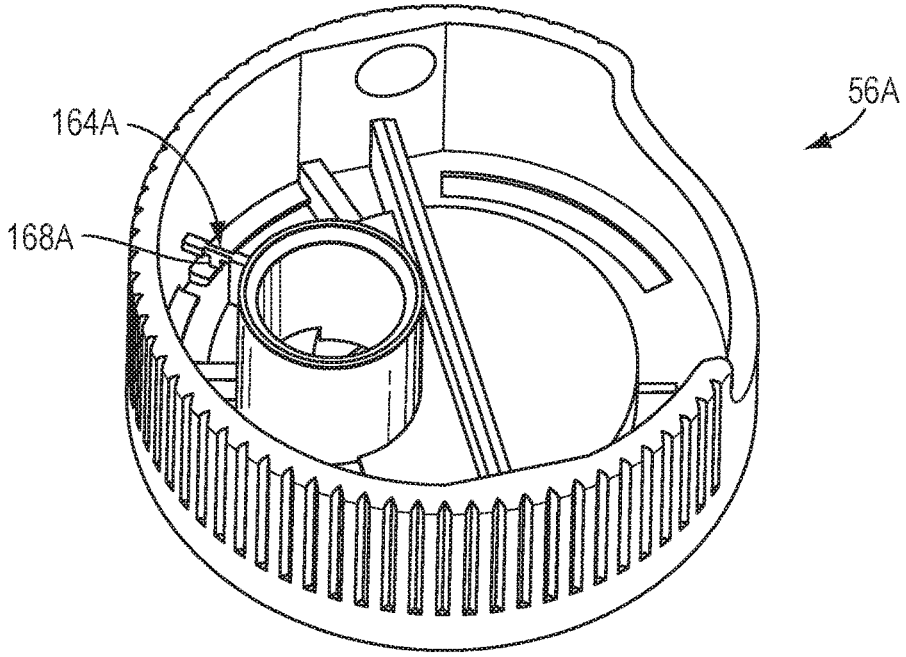
FIG. 32 is a perspective view, taken from above, a locking member of the second embodiment the dispensing closure.
Figure 33:
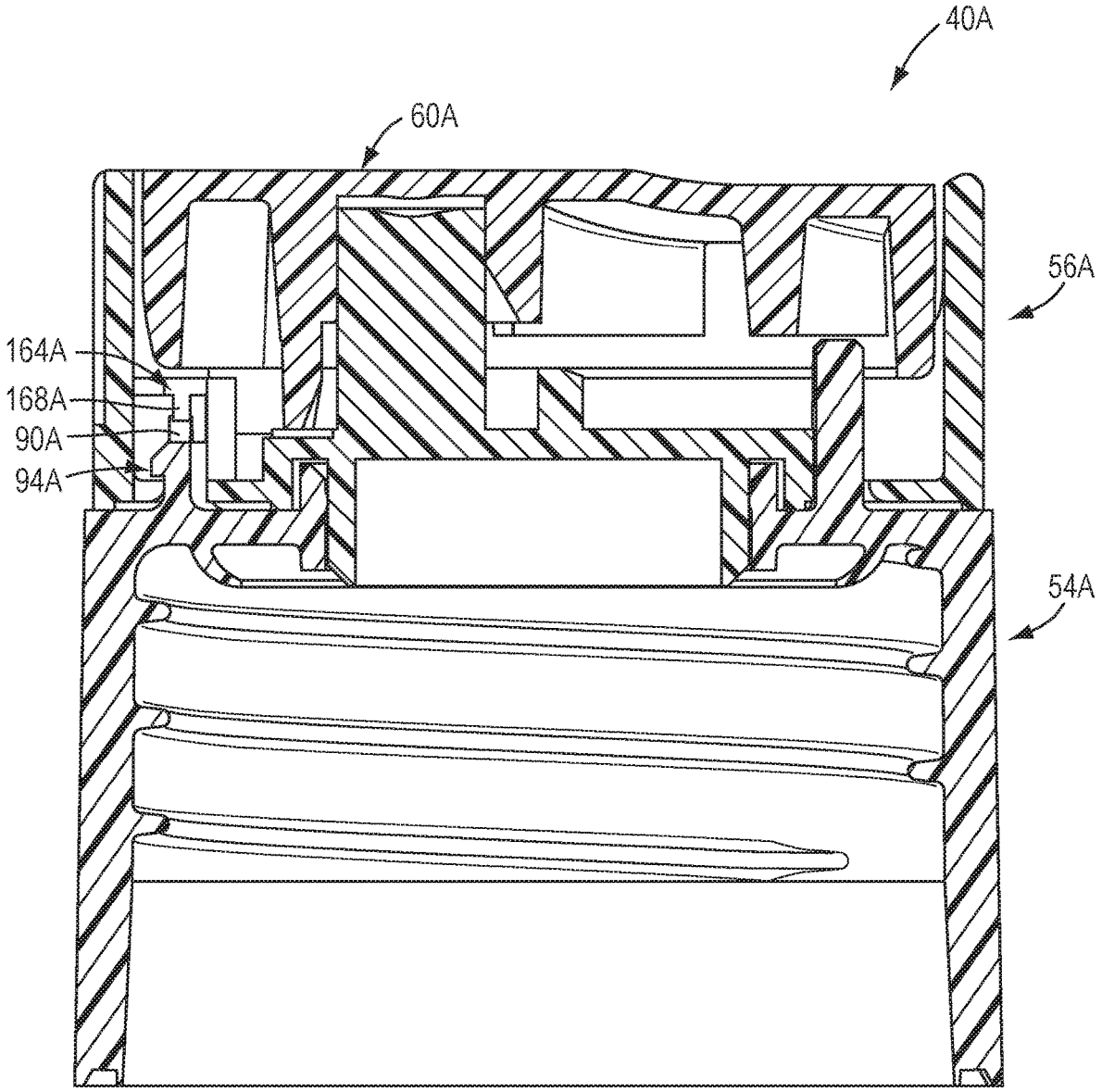
FIG. 33 is a cross-sectional view of the assembled closure body and locking member of the second embodiment of the dispensing closure.

A second embodiment of a closure 40A according to the present invention is illustrated in FIG. 33, and components thereof are illustrated in FIGS. 31 and 32. The closure 40A includes the basic components of a base 54A, locking member 56A, and an actuator 60A. The second illustrated embodiment of the closure 40A operates in the same manner as discussed above with respect to the first illustrated embodiment of the closure 40, with one exception, discussed in detail below, relating to the audible and/or tactile indication of locking and/or unlocking of the closure 40A.

With reference to FIG. 31, the second illustrated embodiment of the closure 40A is also provided with three arcuate lugs or retaining projections 94A extending upwardly from the closure body 54A and which function to couple the closure body 54A with the locking member 56A as described above with respect to the first illustrated embodiment of the closure 40. One of the three retaining projections 94A has triangular projection 90A extending upwardly therefrom.

Referring now to FIG. 32, the locking member 56A of the closure 40A is provided with a radial bridge or span 164A having a downwardly-extending tab 168A. As shown in FIG. 33, when the locking member 56A is installed on the closure body 54A, the tab 168A axially-overlies a portion of the retaining projection 94A on one side of the triangular projection 90A. When the user of the closure 40A rotates the locking member 56A relative to the closure body 54A either to lock or unlock the closure 40A, the projection 90A initially confronts and deflects the tab 168A. Continued relative movement between the locking member 56A and the closure body 54A causes the deflected tab 168A to clear the projection 90A, releasing potential energy as the tab 168A returns to its undeflected configuration, to create an audible and/or tactile indication to the user of the closure 40A.

The present invention can be summarized in the following statements or aspects numbered 1-19:

1. A dispensing closure (40) for a system (44) having an opening (46) between an exterior of the system (44) and an interior of the system (44) where a fluent substance may be stored, said dispensing closure (40) comprising:
   A. a closure body (54) that
      1) can be located at the system opening (46) and that defines an inlet (74) for communicating with the system, and
      2) has an end (70) defining an aperture (84) to accommodate the flow of a fluent substance through said closure body (54);
   B. a locking member (56) mounted on said closure body (54) for rotation about a central rotational axis (A), said locking member (56) having an intermediate flow passage (140) for accommodating the flow of a substance through said closure body aperture (84), said locking member (56) having
      1) a locking position, and
      2) an unlocking position rotated about said central rotational axis (A) away from said locking position; and
   C. an actuator (60) that
      1) is rotatably mounted to said locking member (56) for occluding said locking member intermediate flow passage (140) to prevent flow of a fluent substance through said closure (40) when said actuator (60) is in a closed, non-dispensing position and for permitting flow of a fluent substance through said closure (40) when said actuator (60) is rotated to an open, dispensing position,
      2) includes a dispensing flow passage (190) that is in communication with said intermediate flow passage (140) of said locking member (56) when said actuator (60) is in said open, dispensing position, and
      3) is in engagement with a portion of said closure body (54) when said locking member (56) is in said locking position to prevent said actuator (60) from moving into said open, dispensing position.
2. The dispensing closure (40) in accordance with the preceding aspect 1 in which said closure body (54) is adapted for use with a system (44) that is a container (44) defining said opening (46) and in which said closure body (54) is one of:
   1) a separate structure for being attached to the container (44) at the container opening (46); and
   2) an integral structure that is a unitary part of a container (44) formed at the container opening (46).
3. The dispensing closure (40) in accordance with any of the preceding aspects in which said end (70) of said closure body (54) includes a top deck (80) defining an upper surface (82), and said locking member (56) includes a bottom deck (118) defining a bottom surface (121) confronting said closure body upper surface (82).
4. The dispensing closure (40) in accordance with any of the preceding aspects wherein said aperture (84) of said closure body (54) has a configuration centered on said central rotational axis (A) and at least a portion of said intermediate flow passage (140) of said locking member (56) is offset from said central rotational axis (A).
5. The dispensing closure (40) in accordance with any of the preceding aspects wherein said actuator (60) includes at least one downwardly extending abutment (216) and said closure body (54) includes an upwardly extending abutment (110) whereby said downwardly-extending abutment (216) and said upwardly extending abutment (10) are oriented to engage to prevent said actuator (60) from moving into said open, dispensing position when said locking member (56) is in said locking position.
6. The dispensing closure (40) in accordance with the preceding aspect 5 wherein
   1) said locking member (56) includes a bottom deck (118) defining an aperture (126), and
   2) said upwardly extending abutment (110) of said closure body (54) extends through said aperture (126).
7. The dispensing closure (40) in accordance with the preceding aspect 5 wherein
   1) said upwardly extending abutment (110) of said closure body (54) has a radius of curvature centered on said central rotational axis (A), and
   2) said downwardly extending abutment (216) of said actuator (60) has a length extending an oblique angle relative to said radius of curvature.
8. The dispensing closure (40) in accordance with any of the preceding aspects wherein
   1) said closure body (54) has at least one retaining projection (94) extending upwardly from said end (70), and
   2) said locking member (56) has at least one arcuate slot (122) therein for receiving said retaining projection (94).
9. The dispensing closure (40) in accordance with the preceding aspect 8 wherein
   1) said closure body (56) has a plurality of circumferentially spaced retaining projections (94), and
   2) said locking member (56) has a plurality of circumferentially spaced arcuate slots (122) therein, each one of said arcuate slots (122) receiving a different one of said retaining projections (94).
10. The dispensing closure (40) in accordance with any of the preceding aspects wherein
    1) said end (70) of said closure body (54) has an upper surface (82) with at least one recess (90) therein, and
    2) said locking member (56) has at least one resilient projection (164) having a bead (168), whereby rotation of said locking member (56) relative to said closure body (54) carries said projection (164) in an arc with said bead (168) engaging said surface (82) so that said projection (164) is deflected by said surface (82) until continued rotation of said locking member (56) relative to said closure body (54) carries said projection (164) to a location in which said at least one recess (90) receives said bead (168) whereupon said projection (164) returns to its undeflected condition as said bead (164) snaps into said at least one recess (90) to generate at least one of an audible signal and a tactile signal.
11. The dispensing closure (40A) in accordance with any of the preceding aspects wherein
    1) said closure body (54A) has at least one projection (90A) extending therefrom, and
    2) said locking member (56A) has at least one resilient, deflectable tab (168A) extending therefrom, whereby rotation of said locking member (56A) relative to said closure body (54A) moves said projection (90A) against and past said tab (168A) which deflects and returns to its undeflected condition to generate at least one of an audible signal and a tactile signal.

12. The dispensing closure (40) in accordance with any of the preceding aspects wherein said closure body (54) has at least one indicium (72) and said locking member (56) has at least one indicium (156) that cooperate to indicate whether said locking member (56) is in one of said locking position and said unlocking position.
13. The dispensing closure (40) in accordance with any of the preceding aspects wherein said locking member (56) is rotatable less than 45 degrees about said central rotational axis (A) between said locking position and said unlocking position.
14. The dispensing closure (40) in accordance with any of the preceding aspects wherein
    1) said closure body (54) further includes an upwardly extending wall (86) surrounding and defining at least a portion of said aperture (84), and
    2) said locking member (56) includes a downwardly extending wall (134) sealingly engaged with said closure body upwardly extending wall (86).
15. The dispensing closure (40) in accordance with any of the preceding aspects wherein
    1) said actuator (60) includes a pair of oppositely extending protrusions (188), and
    2) said locking member (56) includes an outer wall (114) having a pair of facing recesses (144) therein to each receive a different one of said protrusions (188).
16. The dispensing closure (40) in accordance with any of the preceding aspects wherein said locking member (56) includes a bottom deck (118) having a plurality of circumferentially-spaced arcuate slots (122) therein, each of said slots (122) having the same radius of curvature, and said bottom deck (118) further includes an arcuate aperture (126) having a radius of curvature less than said radius of curvature of said slots (122).
17. The dispensing closure (40) in accordance with any of the preceding aspects in which
    1) said locking member (56) includes a raised central deck (119) and a spout (138) extending upwardly from said raised central deck (119), and
    2) said intermediate flow passage (140) extends through said raised central deck (119) and said spout (138).
18. The dispensing closure (40) in accordance with any of the preceding aspects in which
    1) said closure body end (70) includes an upwardly extending wall (86), and
    2) said locking member (56) defines an annular channel (130) for receiving said wall (86).
19. The dispensing closure (40) in accordance with any of the preceding aspects in combination with a system (44) that is a container (44) of a fluent substance, the closure (40) and container (44) together defining a package.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A dispensing closure (40) for a system (44) having an opening (46) between an exterior of the system (44) and an interior of the system (44) where a fluent substance may be stored, said dispensing closure (40) comprising:

A. a closure body (54) that
    1) can be located at the system opening (46) and that defines an inlet (74) for communicating with the system,
    2) has an end (70) defining an aperture (84) to accommodate the flow of a fluent substance through said closure body (54), said end (70) terminating in a top deck (80);

B. a locking member (56) mounted on said end (70) of said closure body (54) for rotation about a central rotational axis (A), said locking member (56) having an intermediate flow passage (140) for accommodating the flow of a substance through said closure body aperture (84), said locking member (56) including an outer wall (114) surrounding said intermediate flow passage (140), wherein all of said outer wall (114) is located axially outward of said top deck (80), said locking member (56) having
    1) a locking position, and
    2) an unlocking position rotated about said central rotational axis (A) away from said locking position; and C. an actuator (60) that
    1) is rotatably mounted to said locking member (56) for occluding said locking member intermediate flow passage (140) to prevent flow of a fluent substance through said closure (40) when said actuator (60) is in a closed, non-dispensing position and for permitting flow of a fluent substance through said closure (40) when said actuator (60) is rotated to an open, dispensing position,
    2) includes a dispensing flow passage (190) that is in communication with said intermediate flow passage (140) of said locking member (56) when said actuator (60) is in said open, dispensing position, and
    3) is in engagement with a portion of said closure body (54) when said locking member (56) is in said locking position to prevent said actuator (60) from moving into said open, dispensing position.

2. The dispensing closure (40) in accordance with claim 1 in which said closure body (54) is adapted for use with a system (44) that is a container (44) defining said opening (46) and in which said closure body (54) is one of:
    1) a separate structure for being attached to the container (44) at the container opening (46); and
    2) an integral structure that is a unitary part of a container (44) formed at the container opening (46).

3. The dispensing closure (40) in accordance with claim 1 in which said top deck (80) defines an upper surface (82), and said locking member (56) includes a bottom deck (118) defining a bottom surface (121) confronting said closure body upper surface (82).

4. The dispensing closure (40) in accordance with claim 1 wherein said aperture (84) of said closure body (54) has a configuration centered on said central rotational axis (A) and at least a portion of said intermediate flow passage (140) of said locking member (56) is offset from said central rotational axis (A).

5. The dispensing closure (40) in accordance with claim 1 wherein said actuator (60) includes at least one downwardly extending abutment (216) and said closure body (54) includes an upwardly extending abutment (110) whereby said downwardly-extending abutment (216) and said upwardly extending abutment (110) are oriented to engage to prevent said actuator (60) from moving into said open, dispensing position when said locking member (56) is in said locking position.

6. The dispensing closure (40) in accordance with claim 5 wherein 1) said locking member (56) includes a bottom deck (118) defining an aperture (126), and
2) said upwardly extending abutment (110) of said closure body (54) extends through said aperture (126).

7. The dispensing closure (40) in accordance with claim 5 wherein 1) said upwardly extending abutment (110) of said closure body (54) has a radius of curvature centered on said central rotational axis (A), and
2) said downwardly extending abutment (216) of said actuator (60) has a length extending an oblique angle relative to said radius of curvature.

8. The dispensing closure (40) in accordance with claim 1 wherein 1) said closure body (54) has at least one retaining projection (94) extending upwardly from said end (70), and
2) said locking member (56) has at least one arcuate slot (122) therein for receiving said retaining projection (94).

9. The dispensing closure (40) in accordance with claim 8 wherein 1) said closure body (56) has a plurality of circumferentially spaced retaining projections (94), and
2) said locking member (56) has a plurality of circumferentially spaced arcuate slots (122) therein, each one of said arcuate slots (122) receiving a different one of said retaining projections (94).

10. The dispensing closure (40A) in accordance with claim 1 wherein 1) said closure body (54A) has at least one projection (90A) extending therefrom, and
2) said locking member (56A) has at least one resilient, deflectable tab (168A) extending therefrom, whereby rotation of said locking member (56A) relative to said closure body (54A) moves said projection (90A) against and past said tab (168A) which deflects and returns to its undeflected condition to generate at least one of an audible signal and a tactile signal.

11. The dispensing closure (40) in accordance with claim 1 wherein said closure body (54) has at least one indicium (72) and said locking member (56) has at least one indicium (156) that cooperate to indicate whether said locking member (56) is in one of said locking position and said unlocking position.

12. The dispensing closure (40) in accordance with claim 1 wherein said locking member (56) is rotatable less than 45 degrees about said central rotational axis (A) between said locking position and said unlocking position.

13. The dispensing closure (40) in accordance with claim 1 wherein 1) said closure body (54) further includes an upwardly extending wall (86) surrounding and defining at least a portion of said aperture (84), and
2) said locking member (56) includes a downwardly extending wall (134) sealingly engaged with said closure body upwardly extending wall (86).

14. The dispensing closure (40) in accordance with claim 1 wherein 1) said actuator (60) includes a pair of oppositely extending protrusions (188), and
2) said outer wall (114) of said locking member (56) includes a pair of facing recesses (144) therein to each receive a different one of said protrusions (188).

15. The dispensing closure (40) in accordance with claim 1 in which 1) said locking member (56) includes a raised central deck (119) and a spout (138) extending upwardly from said raised central deck (119), and
2) said intermediate flow passage (140) extends through said raised central deck (119) and said spout (138).

16. The dispensing closure (40) in accordance with claim 1 in which 1) said closure body end (70) includes an upwardly extending wall (86), and
2) said locking member (56) defines an annular channel (130) for receiving said wall (86).

17. The dispensing closure (40) in accordance with claim 1 in combination with a system (44) that is a container (44) of a fluent substance, the closure (40) and container (44) together defining a package.

18. A dispensing closure (40) for a system (44) having an opening (46) between an exterior of the system (44) and an interior of the system (44) where a fluent substance may be stored, said dispensing closure (40) comprising:

A. a closure body (54) that
   1) can be located at the system opening (46) and that defines an inlet (74) for communicating with the system,
   2) has an end (70) defining an aperture (84) to accommodate the flow of a fluent substance through said closure body (54);

B. a locking member (56) mounted on said closure body (54) for rotation about a central rotational axis (A), said locking member (56) having an intermediate flow passage (140) for accommodating the flow of a substance through said closure body aperture (84), said locking member (56) having
   1) a locking position, and
   2) an unlocking position rotated about said central rotational axis (A) away from said locking position; and C. an actuator (60) that
   1) is rotatably mounted to said locking member (56) for occluding said locking member intermediate flow passage (140) to prevent flow of a fluent substance through said closure (40) when said actuator (60) is in a closed, non-dispensing position and for permitting flow of a fluent substance through said closure (40) when said actuator (60) is rotated to an open, dispensing position,
   2) includes a dispensing flow passage (190) that is in communication with said intermediate flow passage (140) of said locking member (56) when said actuator (60) is in said open, dispensing position, and
   3) is in engagement with a portion of said closure body (54) when said locking member (56) is in said locking position to prevent said actuator (60) from moving into said open, dispensing position; and wherein said actuator (60) includes at least one downwardly extending abutment (216) and said closure body (54) includes an upwardly extending abutment (110) whereby said downwardly-extending abutment (216) and said upwardly extending abutment (110) are oriented to engage to prevent said actuator (60) from moving into said open, dispensing position when said locking member (56) is in said locking position; and wherein said upwardly extending abutment (110) of said closure body (54) has a radius of curvature centered on said central rotational axis (A), and said downwardly extending abutment (216) of said actuator (60) has a length extending an oblique angle relative to said radius of curvature.

19. A dispensing closure (40) for a system (44) having an opening (46) between an exterior of the system (44) and an interior of the system (44) where a fluent substance may be stored, said dispensing closure (40) comprising:

A. a closure body (54) that 1) can be located at the system opening (46) and that defines an inlet (74) for communicating with the system, 2) has an end (70) defining an aperture (84) to accommodate the flow of a fluent substance through said closure body (54);

B. a locking member (56) mounted on said closure body (54) for rotation about a central rotational axis (A), said locking member (56) having an intermediate flow passage (140) for accommodating the flow of a substance through said closure body aperture (84), said locking member (56) having 1) a locking position, and 2) an unlocking position rotated about said central rotational axis (A) away from said locking position; and C. an actuator (60) that 1) is rotatably mounted to said locking member (56) for occluding said locking member intermediate flow passage (140) to prevent flow of a fluent substance through said closure (40) when said actuator (60) is in a closed, non-dispensing position and for permitting flow of a fluent substance through said closure (40) when said actuator (60) is rotated to an open, dispensing position, 2) includes a dispensing flow passage (190) that is in communication with said intermediate flow passage (140) of said locking member (56) when said actuator (60) is in said open, dispensing position, and 3) is in engagement with a portion of said closure body (54) when said locking member (56) is in said locking position to prevent said actuator (60) from moving into said open, dispensing position; and wherein locking member (56) includes an outer wall (114) surrounding said intermediate flow passage (140), all of said outer wall (114) is located radially inward of an outermost surface of a body wall (71) of said closure body (54).

* * * * *